US007114662B1

(12) United States Patent
Nikkanen

(10) Patent No.: US 7,114,662 B1
(45) Date of Patent: Oct. 3, 2006

(54) SNOW MAKING USING LOW PRESSURE AIR AND WATER INJECTION

(76) Inventor: John P. Nikkanen, 47 Selden Hill Rd., West Hartford, CT (US) 06107

( * ) Notice: Subject to any disclaimer, the term of this patent is extended or adjusted under 35 U.S.C. 154(b) by 231 days.

(21) Appl. No.: 10/741,281

(22) Filed: Dec. 20, 2003

Related U.S. Application Data

(60) Provisional application No. 60/435,983, filed on Dec. 20, 2002.

(51) Int. Cl.
*F25C 3/04* (2006.01)
*B05B 7/04* (2006.01)
*B05B 7/06* (2006.01)

(52) U.S. Cl. ..... 239/2.2; 239/14.2; 239/433; 239/419; 239/434; 239/424; 239/418

(58) Field of Classification Search ..... 239/2.2, 239/14.2, 433, 419, 424, 418
See application file for complete search history.

(56) References Cited

U.S. PATENT DOCUMENTS 3,952,949 A 4/1976 Dupre
5,004,151 A 4/1991 Dupre
5,810,251 A 9/1998 McKinney
5,823,427 A * 10/1998 Dupre et al. ..... 239/14.2
5,884,841 A * 3/1999 Ratnik et al. ..... 239/2.2
6,129,290 A * 10/2000 Nikkanen ..... 239/2.2
6,543,699 B1 * 4/2003 Dupre ..... 239/14.2
6,547,157 B1 * 4/2003 Jervas ..... 239/14.2

OTHER PUBLICATIONS

Product Sheet, Whittier Canada Enterprise Inc. 12: page, date unknown.
Product Sheets, Lenko Co. (4) pages, date unknown.

* cited by examiner

*Primary Examiner*—David A. Scherbel
*Assistant Examiner*—James S. Hogan
(74) *Attorney, Agent, or Firm*—C. Nessler

(57) ABSTRACT

Snow is made, for use on ski slopes and the like, using compressed air at a pressure substantially less than 95 psig, preferably around 30 psig. The air is provided to a snow making head or snow gun, where it is flowed through an air nozzle having effective diameter D. The air stream intersects a water droplet stream with angle A and at distance L from the air nozzle. Preferred angle A is in the range 70 to 110 degrees. The preferred ratio L/D is in the range 9:1 and 22:1. High pressure air from existing compressor systems is reduced to a desired substantially lower pressure by a central choked flow throttle upstream of an aftercooler, or by multi-stage throttles located near the snow making head. Water is added to the compressed air to substantially improve snow making, particularly when ambient relative humidity is low.

9 Claims, 16 Drawing Sheets

SNOW MAKING USING LOW PRESSURE AIR AND WATER INJECTION

This application claims benefit of provisional patent application Ser. No. 60/435,983, filed Dec. 20, 2002.

TECHNICAL FIELD

The present invention relates to method and apparatus for making snow.

BACKGROUND

The snow ski industry makes extensive use of equipment to produce a "man made" snow which approximates the natural snow and allows for a more predictable ski season. In early versions of snow making devices, water and compressed air were mixed internally and then expanded to atmospheric pressure through a nozzle. Subsequent snow maker designs which mixed air and water externally provided better efficiency snow making. In such units, nuclei, or microscopic frozen ice particles, are generated by the expansion of the compressed air. The nuclei are merged with water droplets issuing from pressure atomizing water nozzles. For examples of such devices, see U.S. Pat. Nos. 5,004,151 and 5,823,427 of Dupre, et al., U.S. Pat. No. 5,810,251 to McKinney, and U.S. Pat. No. 6,129,290 to the applicant herein.

The air-water flow characteristics of some commercial snow making units are shown in FIG. 1. The Type KE, KZ and O units, are representative of early units; Type KZ is an internal mix unit. Types H and M represent more efficient modern units. Water flow varies with the number of water nozzles a particular unit has. All units require compressed air, typically at 95 pounds per square inch, gage (psig) or higher. Since compressed air is a major cost, units that operate in the lower right part of the Figure are more desirable.

The full range of air and water combinations shown in FIG. 1 cannot be always used. Any given unit may not produce fully frozen snow under particular atmospheric conditions, even though the units are typically mounted on top of 20 to 35 foot towers, to provide time for the water droplets to freeze. FIG. 2 illustrates the varied typical empirical capabilities of some prior art snow making units, when making good snow. (The invention is also shown.) FIG. 2 shows that, in general, as wet bulb temperature increases, an increasing ratio of air to water is required. When air flow increases for any given volume of water, the cost of generating compressed air for a given amount of snow rises.

The desirable characteristics of the Type L fan type snow maker are due to the use of only a small quantity of high pressure air nozzles to produce nuclei. A flowing mass of cold ambient air is provided by the fan, to cool the droplets and aid in their projection away from the head. However, fan type units have a great number of small water nozzles, are more complicated and costly, and are heavier, than those which operate only with compressed air and atomized water.

As indicated by the diversity of patents, and by the diversity of equipment in the field, there is a continuing search and need for snow making devices which have favorable air-water ratios, and which are good at producing snow when the environment is difficult, e.g., when wet bulb temperature approaches the freezing point. And, of course, any snow making device must be sturdy, durable, not prone to icing or clogging, and in general, reliable.

SUMMARY

An object of the invention is to substantially reduce the energy costs associated with making artificial snow, especially the cost of providing compressed air. Another object of the invention is to provide a snow making head which more efficiently uses compressed air, and particularly to provide one which is adapted to run at lower pressures than are conventionally known. A further object is provide means for operating snow making heads at low pressures, particularly when using compressors which have already been installed to provide air at high pressures.

In accord with the invention, snow is made in snow making heads, or snow guns, which are provided with compressed air at a pressure which is substantially less than the nominal 95 psig used in the prior art, for example at 25 to 80 psig, preferably around 30 psig. Use of low pressure enables substantially lower air flow for a given water flow, and thus for a given quantity of snow produced. Use of lowered pressure also can provide increased water vapor content in the air flowed through air nozzles and thus more nuclei are produced for a given ambient air condition. Of course, the snow making head has to be capable of effectively using the lowered pressures. Preferably, the low pressure system and method is used in combination with a new snow making head, described below. In accord with the invention, high pressure air from existing compressor systems may be reduced to the desired substantially lower pressure by means of either a central choked flow throttle, upstream of an aftercooler, or by multi-stage throttles located near one or more of the snow making heads, downstream of an aftercooler.

In further accord with the invention, water may be added to compressed air upstream of an aftercooler, in form of a droplet spray or steam vapor, to substantially improve snow making, particularly when ambient relative humidity is low and or when low pressure air is delivered to the snow maker heads. Preferably, water is added at the rate of between 0.01 to 0.04 gallons per minute per 1000 standard cubic feet of compressed air delivered to the nozzle.

In accord with the invention, when air is provided to a snow making head or snow gun, it is flowed through an air nozzle having effective diameter D, so it forms an air stream which intersects a water droplet stream, provided by a water nozzle, at angle A and at distance L from the air nozzle. Preferred angle A is in the range 70 to 110 degrees, more preferably 70–85 degrees. Preferably, the head has a ratio L/D is in the range 9:1 and 22:1.

In a preferred snow making head, the body is tubular, and water nozzles with associated air nozzles are on bosses, which project from the exterior tubular surface of the body. The water nozzles are angled so the water stream has a velocity component along the longitudinal axis of the body, i.e., in the downstream direction of the head. When using the preferred range of angles A, the air stream has a velocity vector component in the upstream direction of the longitudinal axis of the head.

The snow making head of the present invention provides for improved interaction of the air stream with the water droplets and results in superior snow making, for air at high and low pressures. The use of low pressure provides surprisingly substantial reduction in the air needed for making snow, and thus in the energy cost associated with compressing air.

The foregoing and other objects, features and advantages of the present invention will become more apparent from the following description of preferred embodiments and accompanying drawings.

DESCRIPTION

The invention is described in terms of snowmakers that mix compressed air and water externally. In this description, certain definitions and jargon are used. Air issues from an air nozzle and flows as an air stream along an air stream path. Water droplets issue from a pressure atomizing type water nozzle and flow as a water stream along a water stream path. When compressed air expands, the aim is to form nuclei (microscopic ice particles) which mix with the water droplets.

A snow making head, often called a snow gun, is a device which comprises an air nozzle and associated water nozzle, typically, a multiplicity of each in pairs or sets. A snow making system comprises at least one head, typically tens of heads, with associated equipment, such as one or more air compressors, control valves, compressed air coolers (aftercoolers, heat exchangers), pipe lines, and a water supply.

The terms ambient air and atmosphere, unless qualified, refer to the conditions such as pressure, temperature, water vapor content, of the air environment where the snow making system is situated. In this description, it is assumed that the air compression system draws air from the ambient atmosphere and that the snow making head discharges to the same atmosphere. However, local atmosphere condition in proximity to the discharge points of the air and water nozzles of the head can be altered by the functioning of those elements. For example, temperature can increase due to liberation of latent heat of water and relative humidity can change.

An analysis is presented here to describe how the invention works in contrast to the devices of the prior art. U.S. Pat. No. 6,129,290, commonly owned herewith, describes an earlier snow making head, and shows apparatus construction details which can be used in the present invention. The patent also describes phenomena and technology concerning compressed air and the interaction of compressed air with a water droplet plume. The description and figures thereof are hereby incorporated by reference. There are several important factors to consider in snow making, and the present invention. They include: generating adequate nuclei from water vapor which is present in compressed air delivered to a snow making head; the characteristics of the droplets which comprise the water stream; and, how the air and water streams interact.

Figure 3:
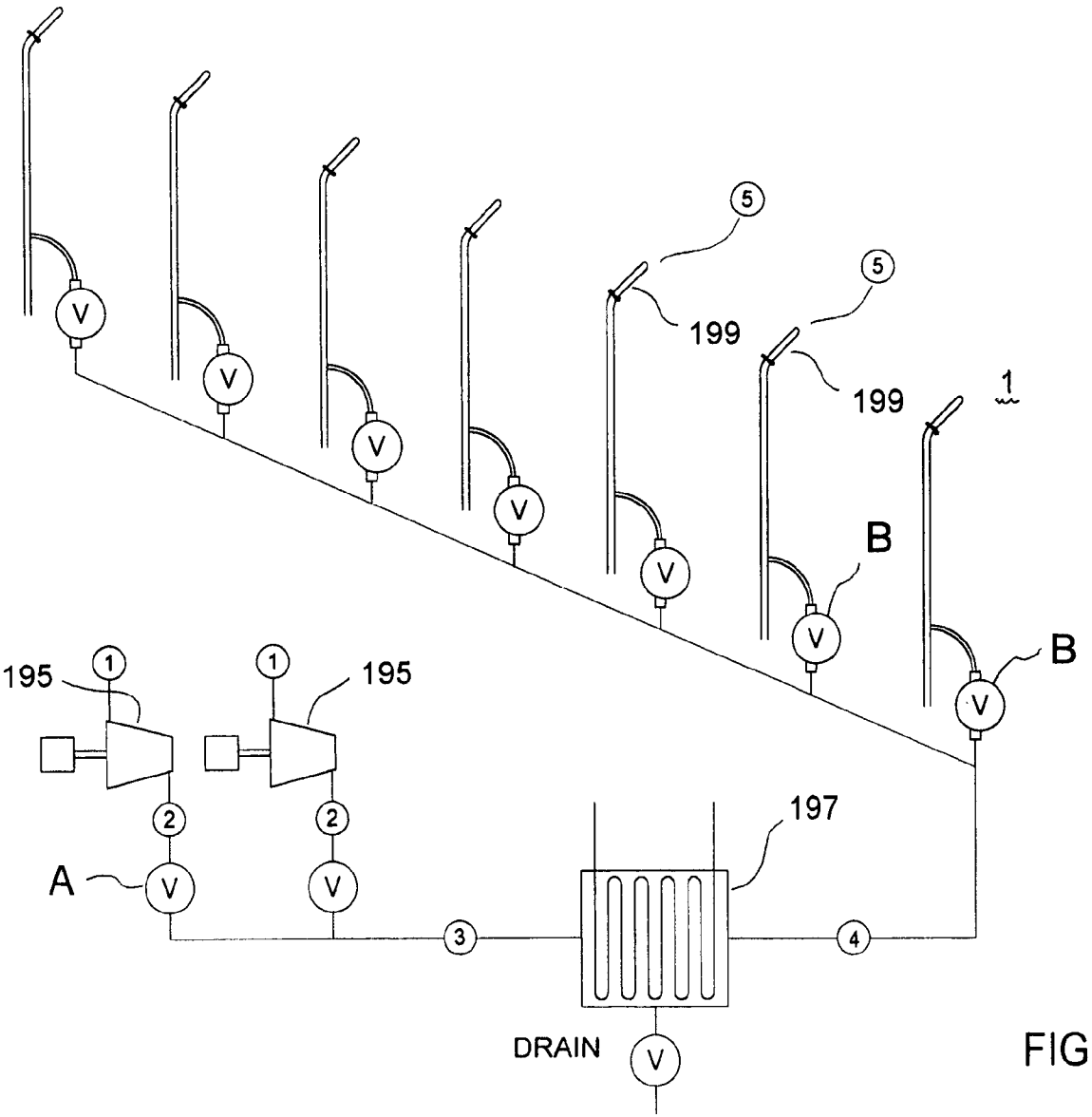
FIG. 3 is a schematic flow diagram of a snow making system.

FIG. 3 is simplified flow diagram for air of a snow making system, configured for carrying out the present invention. Ambient air 1 is compressed by two (or fewer, or more) compressors 195 operating in parallel. Air from the discharge 2 of compressors 195 passes through a main or central throttle A to header 3. It then flows through aftercooler 197 (i.e., an air to air heat exchanger), where it is cooled typically to about 40–50 deg F. (degrees Fahrenheit). At the aftercooler outlet 4 the air enters a piping system which conveys the compressed air to the snow making heads 199. At the heads, air flows through nozzles of the snow making heads, to the ambient atmosphere 1. As air flows through the piping system 33 which connects all the major elements, pressure will be reduced slightly due to velocity induced losses, while air temperature and water vapor content will be altered by heat transfer and condensation at the pipe walls. However, for the sake of simplicity here, these changes will be ignored and it will be assumed that, other than the purposeful effects which are mentioned in carrying out the invention, the air conditions in the entire piping system are the same as at the aftercooler discharge point 4. Use of either the central throttle valve A or the local throttle valves B is discussed further below. In general, throttles of either type are not used in the prior art. Of course, various shut off valves and drains for management of piping systems are commonly used. They will also be used in the present invention, but are not shown for clarity of illustration.

Figure 4:
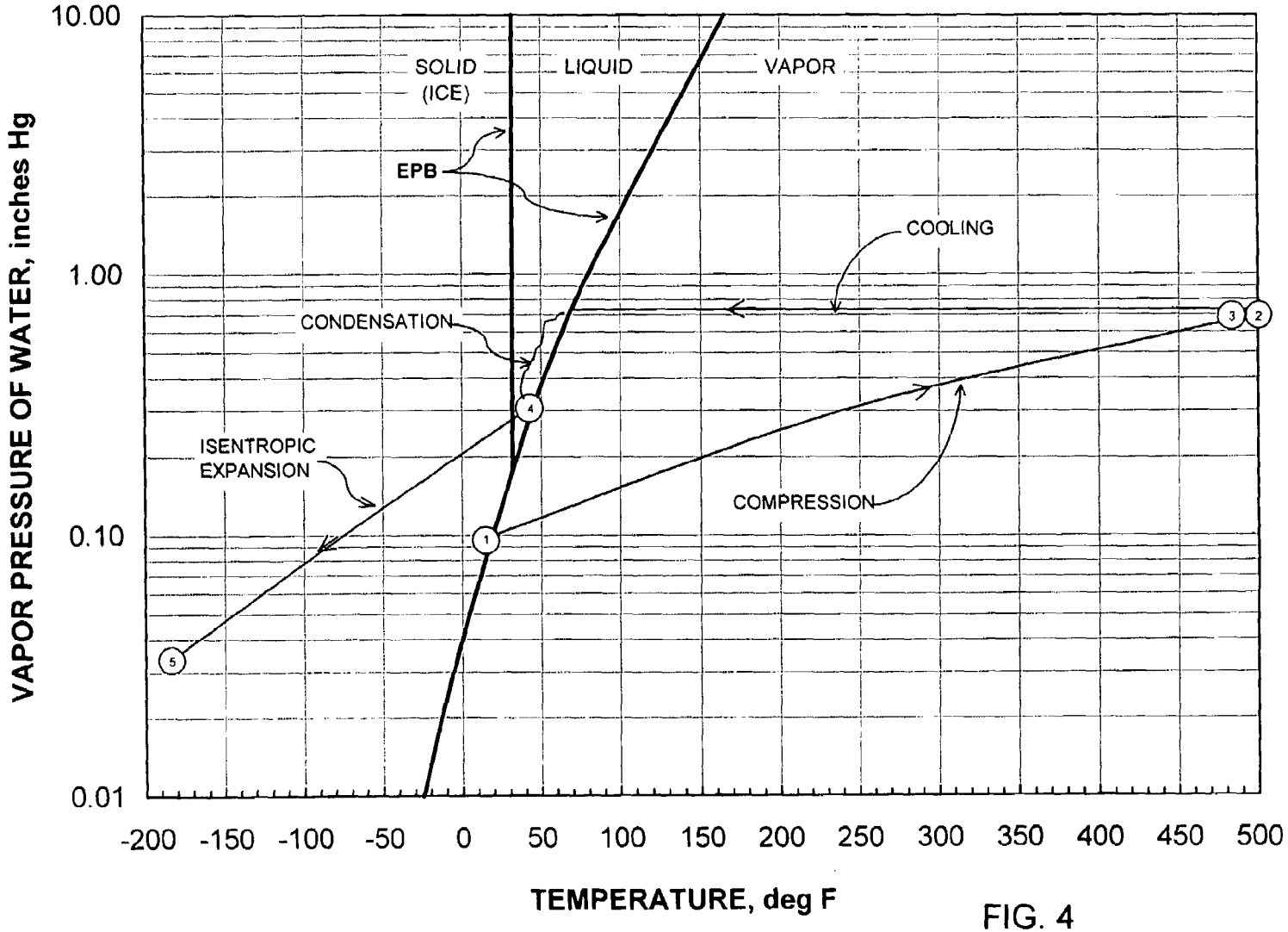
FIG. 4 shows the relationship of the equilibrium phase boundaries EPB for water to a typical compressed air thermodynamic cycle, characteristic of snow making.

FIG. 4 is a phase diagram for water, in terms of the vapor pressure of water and its temperature. It is presented as a prelude to FIG. 5. The phase diagram shows the familiar equilibrium phase boundaries for water (which fork shape curve is labeled EPB in the other Figures described below). Curve EPB indicates the temperature and vapor pressure conditions where, upon cooling, water vapor will convert to liquid, and then to solid; or where it will convert from vapor directly to solid (ice).

In the absence of condensation or other mass exchange, changes in the vapor pressure of water contained in the air, such as the air in the piping system mentioned above, are proportional to changes in air pressure. Specific humidity co is the mass ratio of water to dry air for an air-water mixture. Specific humidity is given by $$\omega \approx \frac{p_v M_v}{p_a M_a} \qquad \text{Eq. (1)}$$

where $p_v$ and $p_a$ are the partial pressures, and $M_v$ and $M_a$ are the molecular weights, of water vapor and air respectively.

Curve I on FIG. 4 shows a compressed air cycle, typical of a snow making system used with prior art external mix snow making devices, such as those mentioned in the Background, when air is compressed to about 95 psig. Numbers at different points along the cycle correspond to those on the flow diagram of FIG. 3. In all cycles pictured in the graphs here, the terminal end of the cycle curve is the point of maximum expansion of air issuing from the nozzle. The terminal end points of the curves in the Figures does not reflect what happens when the air mixes with water droplets or when the air mixes with atmospheric air. There is a connecting air flow path from each terminal point to the beginning point, e.g., from point (5) to point (1) in FIG. 4. That part of the path should be inferred, since it is omitted for clarity of illustration in all Figures.

Curve I shows how the phase of the water contained in the compressed air changes along the compression-expansion cycle path. The curve I, and this part of the description, assumes that the ambient air which is compressed is saturated, i.e., at 100% Relative Humidity (RH). Compression from ambient conditions (1) to compressed state (2), shown on the Figure, follows a path which reflects the compressor efficiency $\eta$, and ratio ($C_p/C_v$) of specific heats, $\gamma$, for the mixture comprising water vapor and air. A compressor efficiency of nominal 85% has been used to construct FIG. 4 and the related figures. The expression for the compression process, from point (1) to point (2), is given by $$TR=(PR^{(\gamma-1)/\gamma}-1)/\eta+1 \qquad \text{Eq. (2)}$$

where TR and PR are the temperature and pressure ratios respectively. Points (2) and (3) are the same because there is no purposeful throttling between those points in prior art systems. Cooling from point (3) to (4) occurs essentially at constant pressure. When the temperature reaches the vapor-liquid saturation line of the phase diagram EPB, condensation can occur in the aftercooler 197, as indicated on FIG. 4, where the line (3)–(4) crosses curve EPB. The uneven line of that part of the path indicates the indeterminate path, as liquid condenses. Then, the air-water vapor mixture expands through the nozzle of the snow maker, to ambient static pressure of atmosphere, as shown by the line running from point (4) to (5). The expansion is essentially isentropic, i.e., 100% efficient, ignoring shock wave losses. The temperature ratio is defined by the expression $$TR=PR^{\gamma-1/\gamma} \qquad \text{Eq. (3)}$$

As the FIG. 4 curve I shows, for this typical example, the resultant final static temperature (5) of the water vapor in the vapor/air stream flowing from the air nozzle of the snow making head mixture is about −180 deg F., significantly below that needed for the onset of equilibrium phase ice. Thus, while one might reasonably expect that the water vapor contained in the compressed air would be transformed to the solid phase, i.e., nuclei, it is well known that water vapor can exist in the supercooled state, without phase change. In one example, the effect is observed when the rate of temperature change is extremely fast, as occurs during expansion of compressed air in snow maker air nozzles. When there is sufficient supercooling, spontaneous homogeneous phase change does ultimately occur, typically in a very short time. All the water vapor in the air-water vapor mixture will suddenly freeze as ice particles, or nuclei. The nuclei are numerous and extremely small, 0.001–0.01 microns in size, and are suited for snow making.

Data from the technical literature indicate when water phase changes occur under the foregoing non-equilibrium conditions: A Non-Equilibrium Phase Boundaries (NEPB) curve is plotted in FIG. 5. The data show phase change for air-water vapor flowing through supersonic nozzles with rapid expansions on the order of 1/10th millisecond. Those data are representative of what happens when air discharges from air nozzles of typical snow maker heads, including the present invention.

Figure 5:
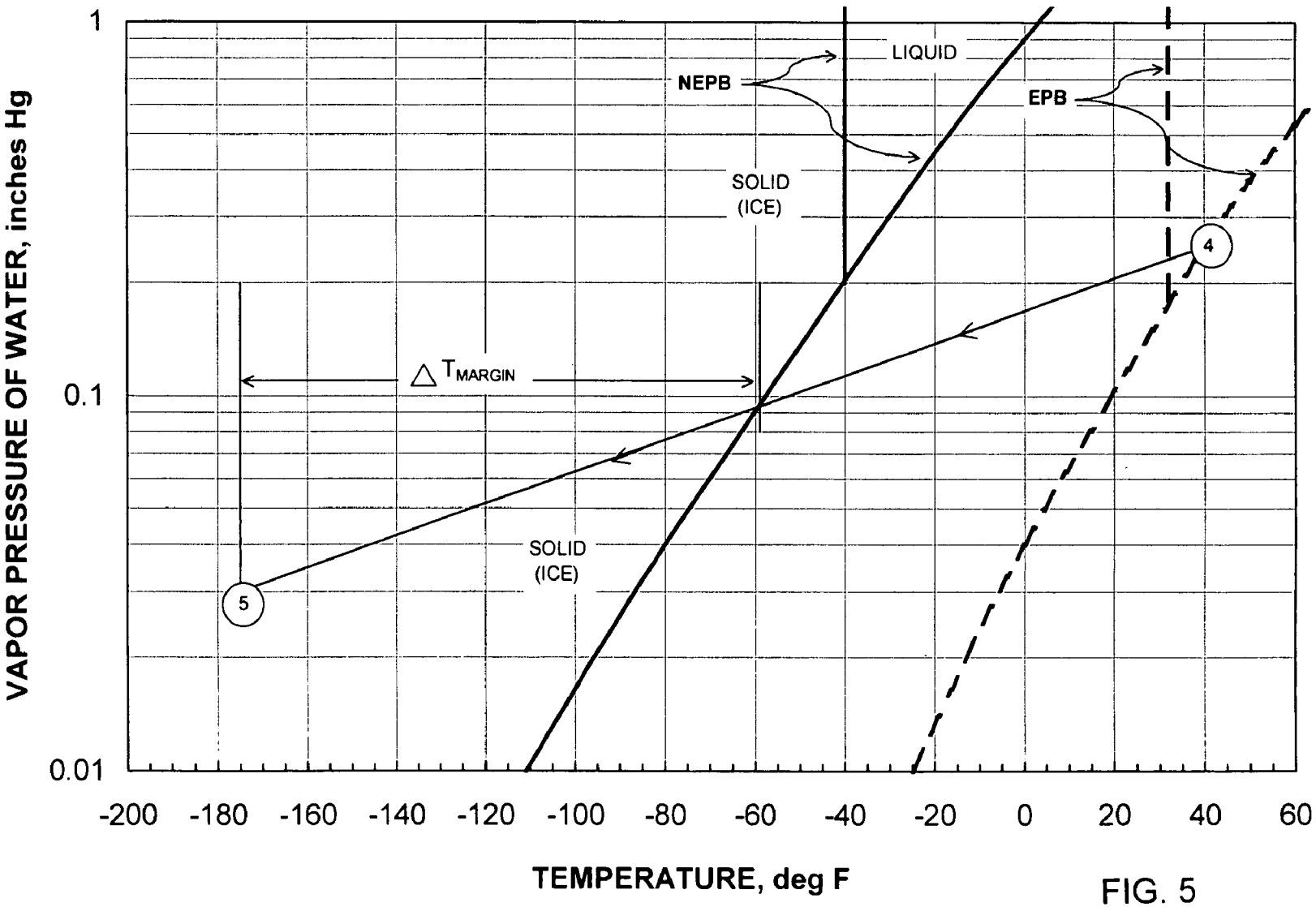
FIG. 5 illustrates the relation between non-equilibrium phase boundaries NEPB for water and the equilibrium boundaries EPB, with the concept of $\Delta T_{margin}$, when the air is compressed to 95 psig and discharged to atmosphere during snow making.

FIG. 5 shows that the non-equilibrium phase change temperature boundary NEPB is shifted by about minus 80 deg F. (to the left in the Figure) from the equilibrium phase boundary EPB, which is also shown on the Figure. The previously described path (4)–(5) is plotted on FIG. 5. It is seen that point (5) is well beyond the non-equilibrium condensation boundary NEPB. That indicates that there will be instantaneous freezing of water vapor in the air as the air moves along path (4)–(5). At point (5) the temperature has dropped to about minus 180 deg F. The difference between the ultimate temperature and the temperate at which the air curve crosses the non-equilibrium phase boundary NEPB is referred to, and shown as, the temperature difference margin ($\Delta T_{margin}$). In FIG. 5, the $\Delta T_{margin}$ is about 110 deg F. (the difference between the ultimate temperature of about-minus 180 deg F. and the about minus 70 deg F. temperature at which NEPB is crossed).

The present invention is based on the discovery that it is not necessary to compress air to high pressures of around 95 psig, in order to get good snow making. However, in some instances, water vapor must be added to lower pressure air, and the head must be specially configured, for good results. In the following description, a low pressure of 30 psig is used as an example; and, it is compared with the typical prior art pressure example of 95 psig. Other low pressures, intermediate 30 psig and 80 psig, and pressures slightly lower than 30 psig, are also useful and within the scope of invention.

Typically prior art snow making system compressors are designed for and provide air in the range of 90–125 psig, most often 90–100 psig. Sometimes they may be operated at pressures as low as 80 psig. Thus, a reference herein to 95 psig as used in the prior art may be construed as a system where the pressure is in the range 90–125 psig, sometimes maybe as low as 80 psig. In the invention, pressures which are substantially less than 95 psig are referred to. That should be construed as a pressure which is less than 80 psig.

For good snow making with a given snow making head, over a range of ambient conditions, particularly in the so-called difficult range of about 25–30 deg F. wet bulb, one should use the head which is described further below. However, within the generality of the invention, it will be feasible to apply the low pressure invention to certain prior art snow making heads, and to yet to be designed future heads, especially when wet bulb conditions are especially favorable.

Figure 6:
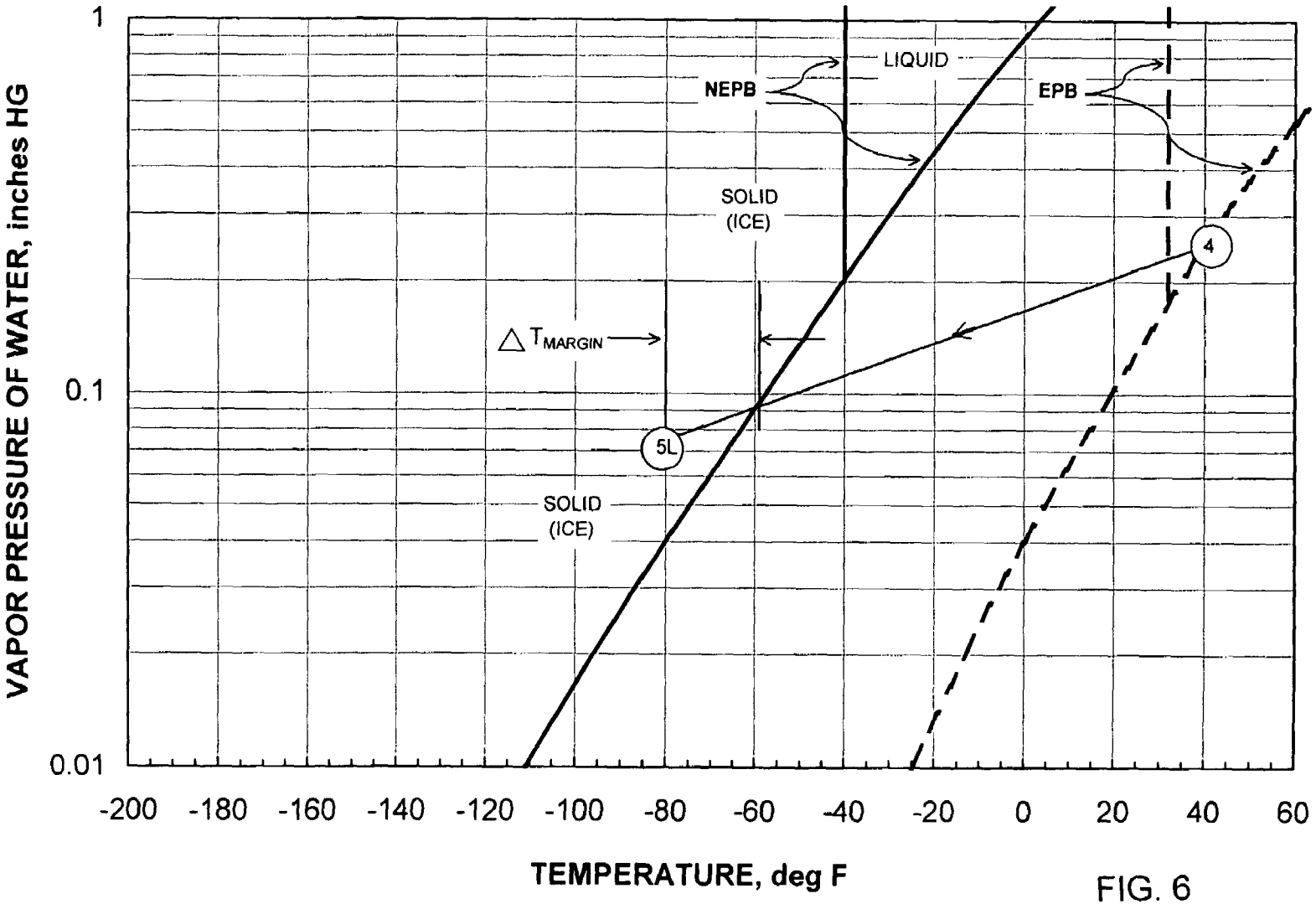
FIG. 6 is like FIG. 5 and shows how expanding air from 30 psig can be produce sufficient $\Delta T_{margin}$, to thereby be useful in producing nuclei.

FIG. 6 shows that a static gas temperature of minus 96 deg F. is achieved upon expanding 30 psig air to ambient pressure along the path from (4) to (5L). The $\Delta T_{margin}$ achieved with low pressure air is about 35 deg F. That is, the temperature at (5L) is about minus 95 deg F. is compared to where the curve crosses the non-equilibrium condensation/freezing boundary temperature, at about minus 60 deg F. Thus, water vapor in the compressed air will freeze, to provide nuclei.

Figure 7:
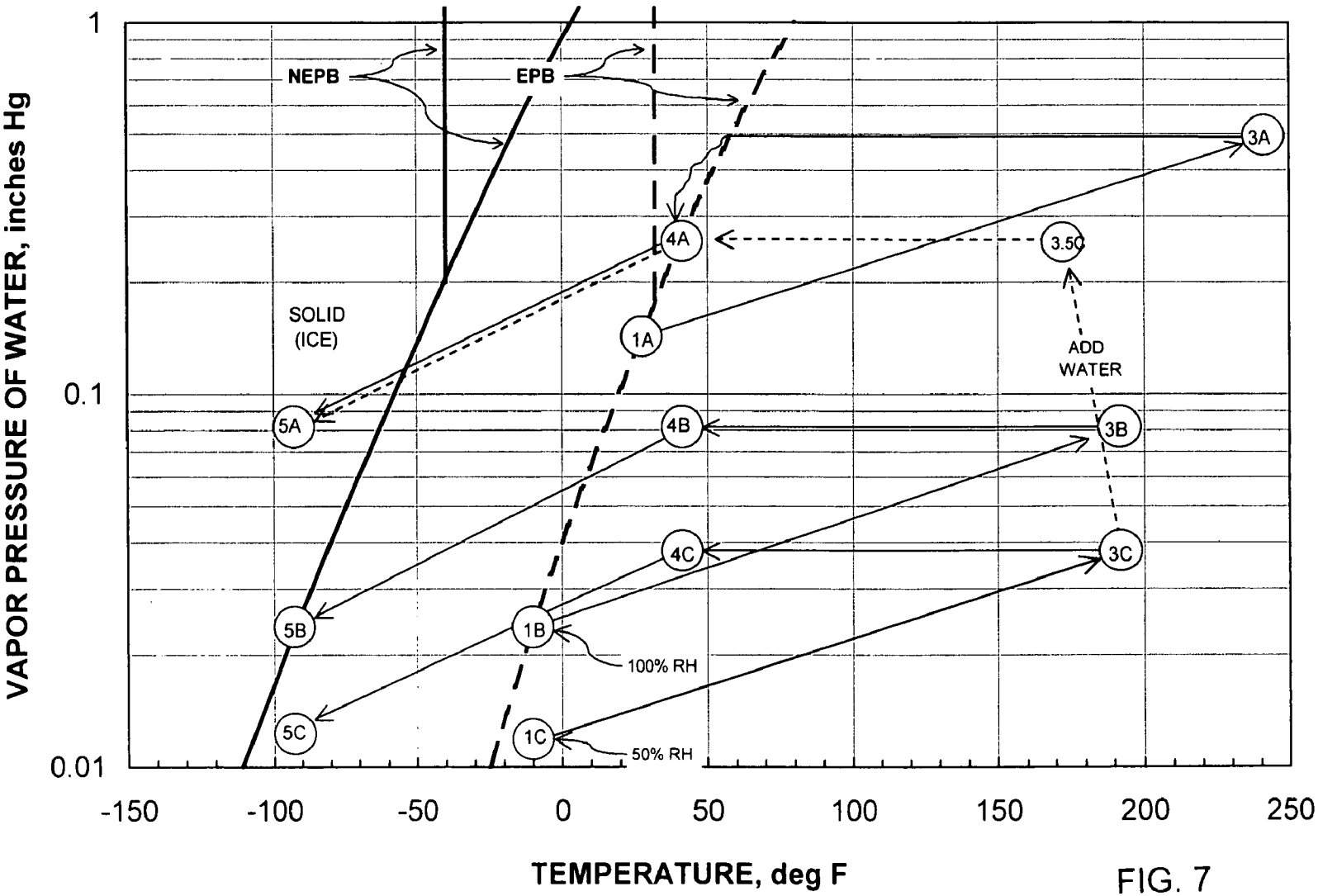
FIG. 7 shows the different thermodynamic cycles which result when air, having different ambient conditions, is compressed to 3.0 psig and then expanded through a nozzle in a snow making system. Also shown is the effect of adding water after the air is compressed.

FIG. 7 is constructed similarly to the prior Figures. Steps along the path of different compressed air cycles are shown. The steps are distinguished by an essential number, which corresponds to a related cycle step, with an alphabetic suffix. All curves represent compression to 30 psig. The lines running from points (1A) to (5A) illustrate again how air compressed to only 30 psig is effective for producing nuclei when the ambient input air to the compressor is at 28 deg F. The ultimate temperature at point 5(A), about minus 90 deg F., is well beyond the non-equilibrium boundary NEPB. Thus, nuclei necessary for snow making are formed.

FIG. 7 illustrates a problem that occurs as ambient temperature falls, and the solution, when using low pressures, especially when the air relative humidity is low. It illustrates why, in an embodiment of the invention, water is added to the compressed air in the form of liquid spray or vapor (steam). Consider the curve (1B) to (5B). Saturated ambient air, that is, having 100% Relative Humidity (RH), at minus 10 deg F., is compressed to 30 psig along path (1B) to (3B). It is then cooled (in the aftercooler) along path (3B) to (4B); then expanded along path (4B) to (5B). It is seen that, at point (5B), the non-equilibrium phase boundary is just reached; and there is negligible $\Delta T_{margin}$. Thus, the desired nuclei formation and snow making will not be achieved.

Now, suppose the ambient air at the same temperature is not fully saturated, but is at 50% relative humidity. The curve (1C) to (5C) shows what happens. Following compression, cooling, and then expansion, the static temperature at point (5C) falls short of the NEPB. As a result, there is an even greater shortfall in the direction of producing nuclei.

When there is ambient air condition like that at points (1C) or (1B), good nuclei can be produced by injecting a quantity of water into the air at the compressor discharge point. This process is illustrated by the line running from point (3C) to point (3.5C). In the example, about water is injected at the rate of 0.014 gallons per minute (gpm) for every 1000 standard cubic feet per minute of air (scfm) which is flowed to the snow making heads at 30 psig. The moisture-laden air is then passed through the aftercooler, carried to the snow making head, and expanded; thus following the path (3.5C) to (4A) to (5A). That last part of the cycle runs along the same path as that followed by air which starts from 28 deg F. ambient. The Figure shows there is adequate $\Delta T_{margin}$, indicating nuclei will be produced and good snow making will result.

Water may be injected into the compressed air as a fine spray or as steam, or in part by each. The choice will be made based on where the water is being injected and the conditions in the air when the water is being injected, with the aims of having all the water vaporize and minimizing local condensation. Generally, liquid water can be injected when the air temperature is hot or the air is relatively dry; and, steam will be used when the air is cool or near to saturation. A relatively small amount of water injection can help, particularly when the end point of expansion is very near the NEPB. Water will be added in the range of 0.01 to 0.04 gallons per 1000 standard cubic feet of air (alternately stated as 0.01 to 0.04 gpm/scfm).

As supported by Equation (1), specific humidity Ω, which is a measure of water content of any given mass of air-water mixture, increases as mixture pressure is reduced. Higher water contents in compressed air delivered to snow making heads mean nuclei will be produced, when they otherwise would not have been; or greater number of nuclei will be produced than otherwise.

Figure 8:
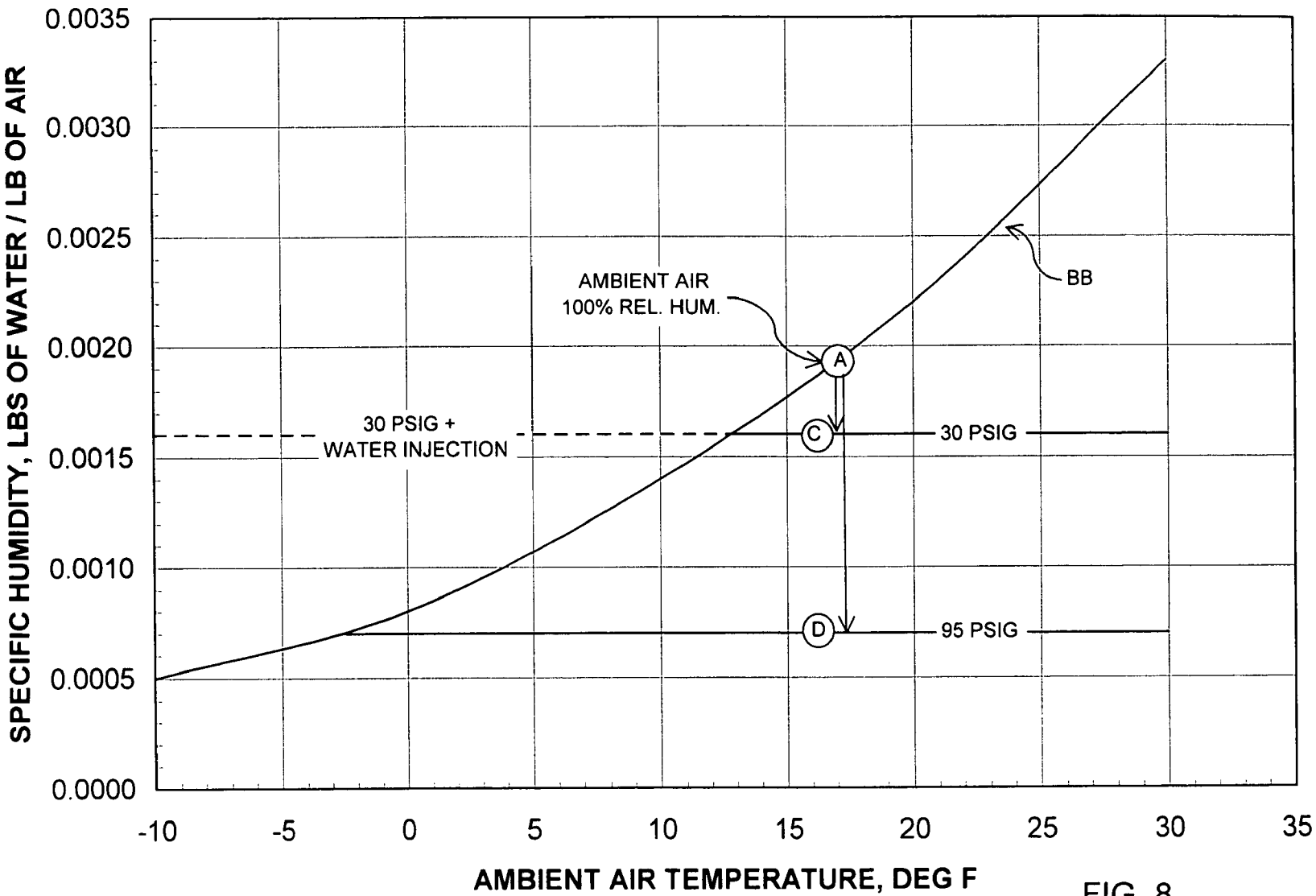
FIG. 8 illustrates how a lower pressure of compressed air enhances the ability of the air to deliver an increased amount of water to the snow making head, for forming nuclei.

FIG. 8 illustrates, by the example of 30 psig, how specific humidity is improved by compressing air to a pressure substantially less than 95 psig. In FIG. 8 it is assumed the ambient air has 100% relative humidity; is compressed and then cooled to about 40 deg F. in the aftercooler. Line BB is a reference line that shows the specific humidity change with temperature, for ambient air at 100% relative humidity. Point A represents an example of typical ambient air drawn into a compressor, at 22 deg F. and 100% relative humidity. The arrows running downwardly to points C and D indicate the direction of change in specific humidity, Ω, when compressing air to two different pressures. The arrows do not inform about the cycle path. It is seen that twice as much of the original water is retained when air is compressed to 30 psig, compared to 95 psig. While 95 psig air will still provide sufficient nuclei for snow making, FIG. 8 shows the substantial superiority of using 30 psig. The greater number of nuclei will provide superior results. The water that is lost from the air, in each example, is condensed in the aftercooler or piping, and drained away.

A corollary of the foregoing is that even if air is compressed to a high pressure, then reduced in pressure by a throttle, and then cooled, it will retain more moisture than the same air which is cooled without being reduced in pressure. More moisture in the air both beneficially increases $\Delta T_{margin}$, and produces more nuclei per unit volume of air.

Calculations enable an estimate of the quantity of freeze-inducing nuclei produced per water droplet varies with certain parameters. In particular, consideration has been given to the effect of different ambient air temperatures, for the different system pressure conditions and cycles which have been described above. The estimate of nuclei available for interacting with water droplets takes into account, in an approximate way, the annihilation of frozen nuclei that melt in the bulk water droplet plume before the local temperature of entrained ambient air and water spray falls below 32 deg F. from an assumed about 40 deg. F. temperature of air and water delivered to the snow making head. It will be no surprise that the number of nuclei drop as temperatures approach 32 deg F.; and that at very cold temperatures, less than 0 deg F., the number of nuclei also drop. For temperatures below about 10–15 deg F., calculations indicate that a system with a central throttle, which reduces pressure, so it enters the air nozzle at about 30 psig, produces less nuclei than the same nozzle which is provided with the baseline 95 psig. Above that temperature range, the amounts of nuclei are approximately comparable. The local throttle system is inferior in calculated number of nuclei across the whole temperature range, but it is still useful. When water is injected in coordination with the use of central throttle, then the number of nuclei produced across the whole temperature range can be made comparable to the baseline 95 psig system.

In general, it is not feasible to change the compression ratio of a 95 psig air compression system which is installed in the field to carry out the prior art practices. There are two different essential options within the invention, for applying the invention to such fixed pressure compressor installations which already exist. Both employ one or more throttles in the piping system, between the compressor and snow making head air nozzle. With reference to FIG. 3 again, in one embodiment of the invention, pressure reduction is accomplished by using a local throttle B at each individual snow making head 199. Alternately, the pressure reduction may be accomplished by use of a main, or central throttle A in the compressor discharge pipeline, upstream of the aftercooler. (Two compressors and two throttle valves are shown in FIG. 3. The throttles are shown with the symbol "V" in the Figure. But for reasons explained below, they could be, but will not usually or likely be, common adjustable valves.) In still another embodiment, not illustrated, the air from the aftercooler is sent to a multiplicity of distribution pipelines in the piping subsystem that feed sub-sets of snowmakers; and, a throttle is installed at the inlet end of each distribution pipeline. In the invention, this alternative is not phenomenologically different from having a throttle at each head.

Figure 9:
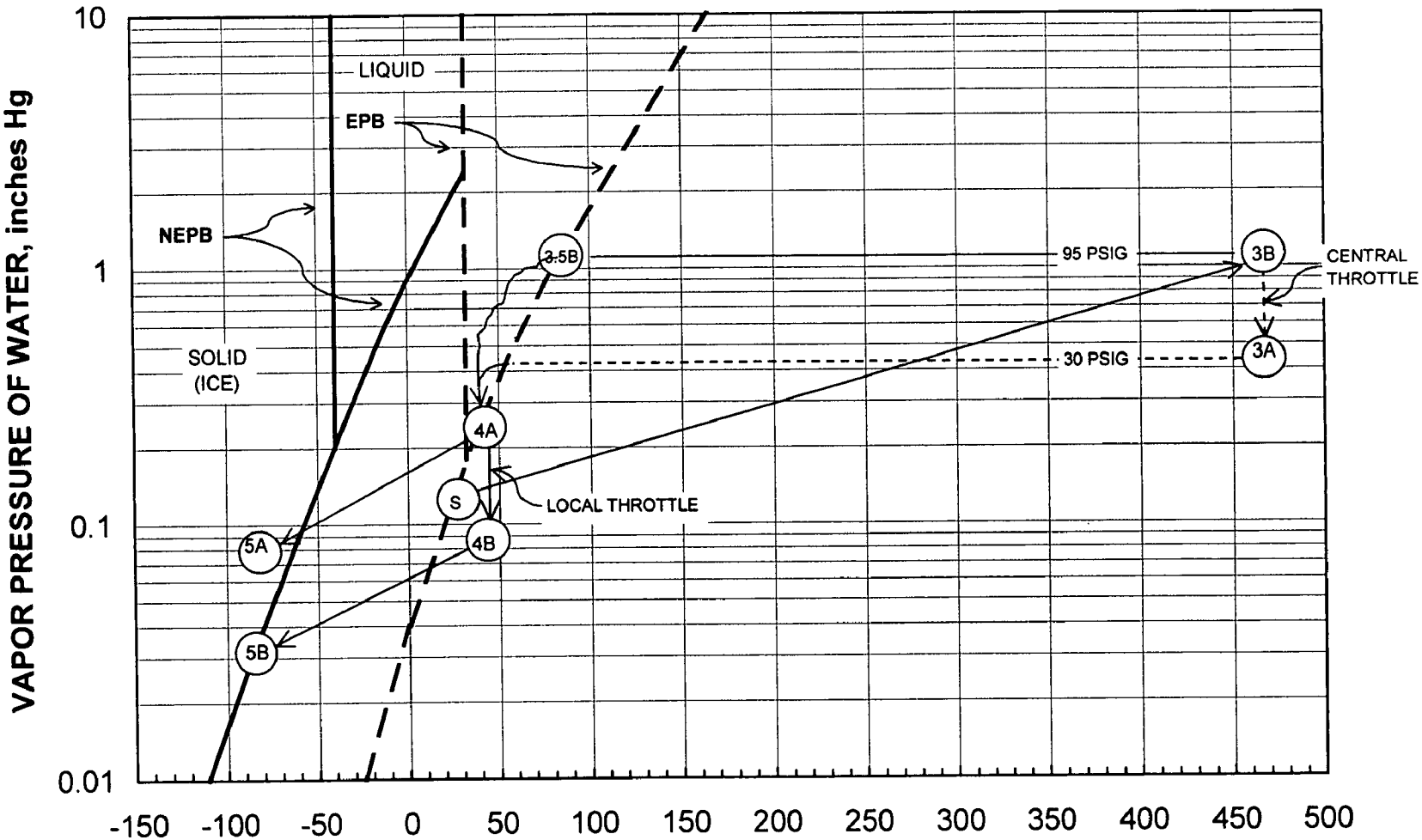
FIG. 9 shows the compressed air cycles when air is compressed to 95 psig and then throttled to 30 psig in two alternative ways, either by a central throttle or by local throttles by the snow making heads.

When the ambient air has less than 100% Relative Humidity, it is preferable to use the central throttle A. Use of the central throttle means more water will remain in air which has passed through the aftercooler, as indicated above; and, makes it more convenient to inject water. The comparison is illustrated by FIG. 9. The starting point ambient air, at about 25 deg F. and 100% RH, is shown at S. The air is compressed to 95 psig, shown by point (3B). Then, in the one alternative, the air passes through the central throttle, to be reduced to 30 psig at point (3A). The air then follows path (3A) to (4A) to (5A). As air passes through the aftercooler, water is removed by condensation. This is the cause of the curving down-slope of the air path as it approaches (4A). When the air is then expanded, upon the exiting snow making head nozzles, the air crosses the non-equilibrium phase boundary to reach point (5A). Thus nuclei are formed.

In comparison, with the use of local throttles, the air follows the path (3B) to (3.5B) to (4A) to (4B) to (5B). More water is removed while the air remains at high pressure and flows through the aftercooler. Now, when the air is expanded at the local throttle, along path (3.5B) to (4B), and passed through the snow making head, along path (4B) to (5B), there is less potential for nuclei. The endpoint (5B) for the example is just at equilibrium phase boundary, which is not satisfactory. When pressure is reduced by local throttles, the amount of condensation within the delivery system as a whole, at the aftercooler and throttle, can be essentially the same as that for the baseline high pressure system. As described below, the local throttle should be configured for staged reductions of pressure that will avoid premature formation of nuclei and resultant problems. Throttling at the inlets of branch pipelines, down stream of the aftercooler, will produce a result similar to that using local throttles B In a generalization from the foregoing, for any given starting condition the $\Delta T_{margin}$ will be equal or greater for the central throttle, compared to a local throttle. The greater the delta-T margin, the more assurance nuclei will be produced in context of variables encountered in the field. FIG. 9 shows that for any given level of temperature margin which is desired, a lower air pressure is usable when the central throttling is used.

When the pressure reduction is accomplished downstream of the aftercooler, for example at local throttles B near the snow maker heads or at substitutional throttles for branch distribution pipelines, prematurely condensing water vapor inside the pressure throttle reducing device should be avoided. Thus, in the invention, a throttle is designed so that the compressed air static temperature does not drop to nearly the spontaneous condensation boundary for air. What the tolerable temperature drop might be will be understood from the prior discussion, and will depend on the particular operating conditions in the air pipeline that is being throttled.

Figure 10:
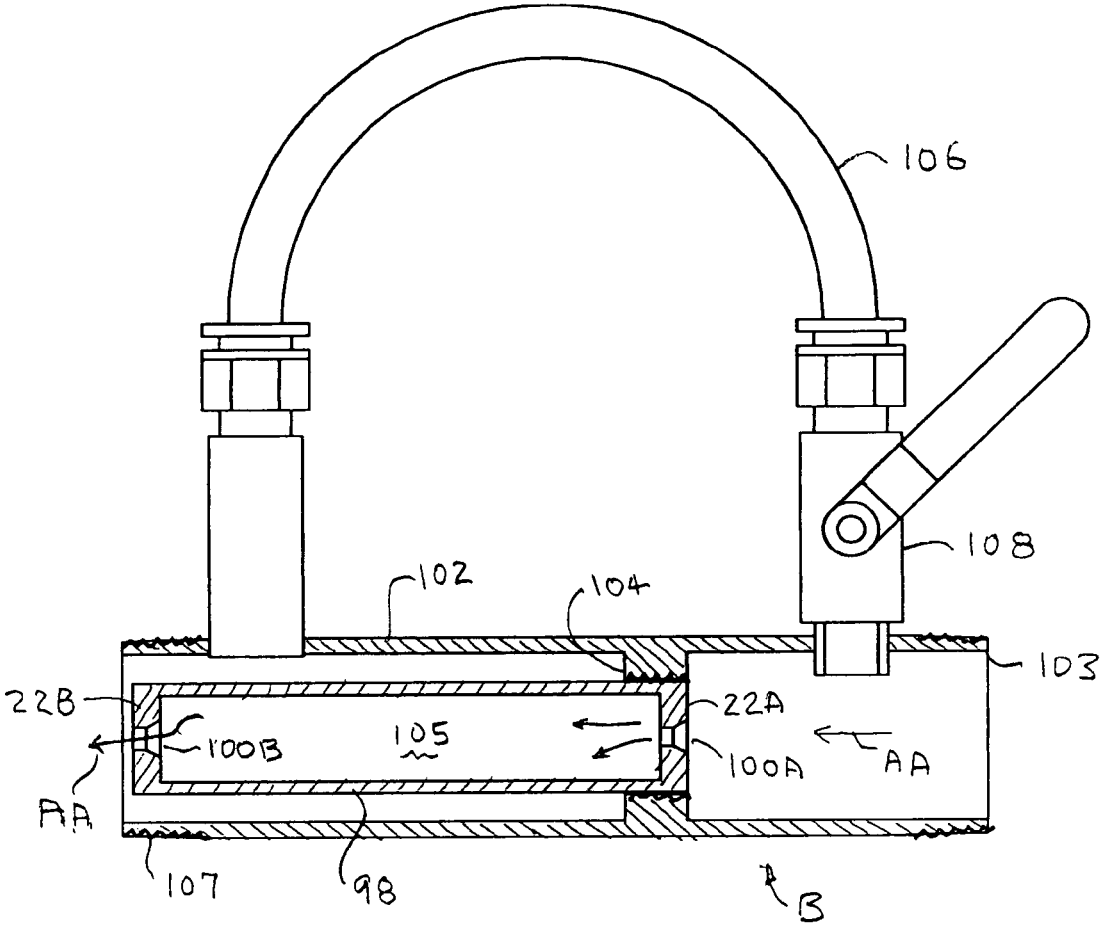
FIG. 10 shows the construction of a local throttle device which has two stages along with a bypass line.

In one local throttle embodiment, shown in FIG. 10, throttle B is comprised of two spaced apart restrictor plates 22A, 22B, connected by sleeve 98, which screws into boss 104 inside body 102, which connects in the compressed air pipeline. Air flows as indicated by the arrows AA, from throttle inlet end 103, thought the interior 105 of sleeve 98 and to throttle outlet end 107, and then to the snow making head. Each restrictor is an orifice plate 22 having hole 100A, 100B, respectively. The flow area of each restrictor hole provides a pressure drop through that restrictor which is insufficient to produce an unwanted temperature drop which will result in spontaneous condensation of moisture of the air flowing through. More than two restrictors and restrictors having other openings, such as radial slots or multiple holes, many be used. Preferably, the throttle comprises an integral bypass line 106 with ball valve 108, so that air can be allowed to run directly from inlet end 103 to exit end 107, when no throttling is desired.

When using any kind of throttles, it will be desirable, if not mandatory, to protect the compressor from adverse effects of not being able to output the flow for which it is designed, or in some instances, of discharging to pressures which are low. To cope with an array of heads which have flow capacity less than the capacity of the compressor, compression release devices or on-off cycling may be used with piston type compressors. For the more prevalent axial flow compressors, use may be made of pressure relief devices, such as blow off or bleed valves. Other mechanisms and or controls, which alter the compressor output when pressure peaks, may be used, as known in the art.

Preferably throttle A is a choked flow venturi, namely a converging-diverging nozzle, wherein the air reaches its limiting (sonic) velocity in the nozzle throat and there is virtually no pressure loss. The diameter of the throat in the choked flow venturi of a particular system is matched to the flow output of the compressor at its design pressure. The choked flow venturi makes the compressor "see" the same downstream pressure, regardless of what the downstream pressure is beyond the throttle, in the piping and at the snow making head. Thus, with a choked flow device, a 95 psig compression system can be used for snow making heads capable of operating anywhere in the range 15–95 psig. Other throttles which produce the same essential choked flow throttle effect, albeit with less efficiency, such as a simple converging nozzle or an orifice plate, will be usable.

In the generality of the invention, there need not be a throttle when a 95 psig high pressure systems is used to supply snow making heads with low pressure (ignoring potential adverse effects on the compressor system). When the flow capability of an array of heads supplied with low pressure air is greater than the design flow capacity of the compressor, the pressure in the piping to the heads will automatically drop. So, in one implementation of the invention, lower pressure to the air nozzles of the heads is accomplished by increasing the number of snow making heads which are on-line, compared to the number of heads used for 95 psig operation. In another alternative, if there are multiple 95 psig compressors, one or more may be taken off line, so that the flow provided to a given array of heads drops.

The following describes how air flowing from the nozzle of a snow making head has several effects which are a function of the combination of velocity and mass of air flow, in relation to the water flow. It shows how surprisingly good results can be obtained when unique air-water stream impact angles and L/D ratios are used. D is the air nozzle opening diameter, and L is the distance from the downstream functional end, or face, of the air nozzle opening to the point where the centerline of the water droplet and air stream flow paths meet. The prior art is first briefly reviewed for context.

Widely used prior art external mix snow making guns, which use high pressure air in combination with high pressure water, have constructions along the lines disclosed in certain patents. For instance, a commercial McKinney Snowgun, sold by Whittier Canada Enterprise, Inc., Caledon East, Ontario, Canada has a design and operation generally in accord with what is described in McKinney Pat. No. 5,810,251, the disclosure of which is hereby incorporated by reference. The commercial HKD Snowgun (Snow Economics, Inc., Natick, Mass., US) has a largely similar construction and operation. See Pat. No. 5,823,427 to Dupre. To generalize, these types of typical prior art units have opposing side pairs of water nozzles with associated air nozzles. Typically, there is a front pair and a rear pair; but there may be more pairs.

Figure 11:
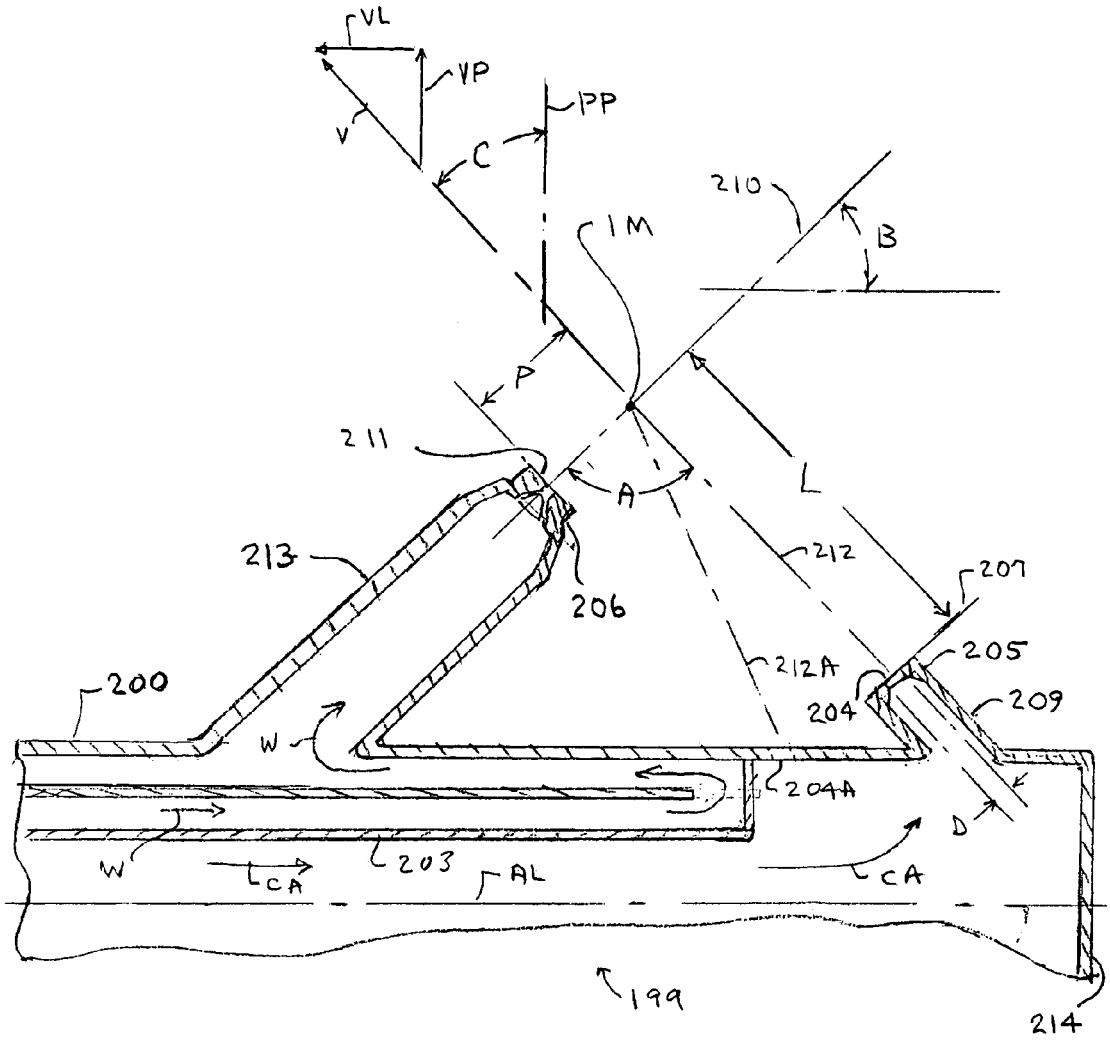
FIG. 11 shows the essential geometric relationship for a simplified snow making head in longitudinal centerplane cross section.

FIG. 11 illustrates the invention, but reference to it will aid understanding of the prior art units, as follows. Typically, water droplets discharge from a nozzle 206 with a flat fan pattern and flow downstream along a path which has an angle B of 25 to 45 degrees to the longitudinal axis AL of the snow gun. Air from nozzles located on the outside cylindrical surface of the snow gun body discharge air in the perpendicular plane of the unit. The angle of impingement between the air flow and the water flow (angle A, in the Figure) is 45–65 degrees. Typically, ski slopes operate prior art units at 95 psig air pressure and 100–600 psig water pressure, or more. Most of the prior art units provide effective snow making, but compared to the present invention, they consume more air for a given amount of water flow and snow creation. An aim of this aspect of the present invention is to provide an improved snow making head which can operate at both low pressures and high pressures.

Another type of commercial snow maker is the fan unit. A typical fan unit comprises a high volume axial flow fan, for flowing air through a duct into which there can be as many as 450 small water nozzles and tens of "nucleator nozzles", which discharge respectively water and 95 psig compressed air. Model ST5 snow making unit is a typical system (Lenko Co., Östersund, Sweden). The typical fan unit does not have an air stream impinging on a water droplet stream, like the external mix units, described just above. The low pressure invention will be applied to fan units by providing air at pressures as low as 15–25 psig, and flowing the air from air-only nozzles which replace the prior art nucleator nozzles. Air consumption will be reduced. Water in vapor form, such as steam from a boiler, will be added to the compressed air flowing to the air nozzles, with the same air/water ratios which are mentioned below.

The use of substantially lowered pressure can often be employed with the prior art external mix snowmakers, if ambient conditions are appropriate, e.g., when the air is quite cold. But when pressure to prior art units is reduced too substantially and or if wet bulb temperature is too high, the snow becomes exceedingly and undesirably wet or slushy, or there is no snow at all.

Figure 12:
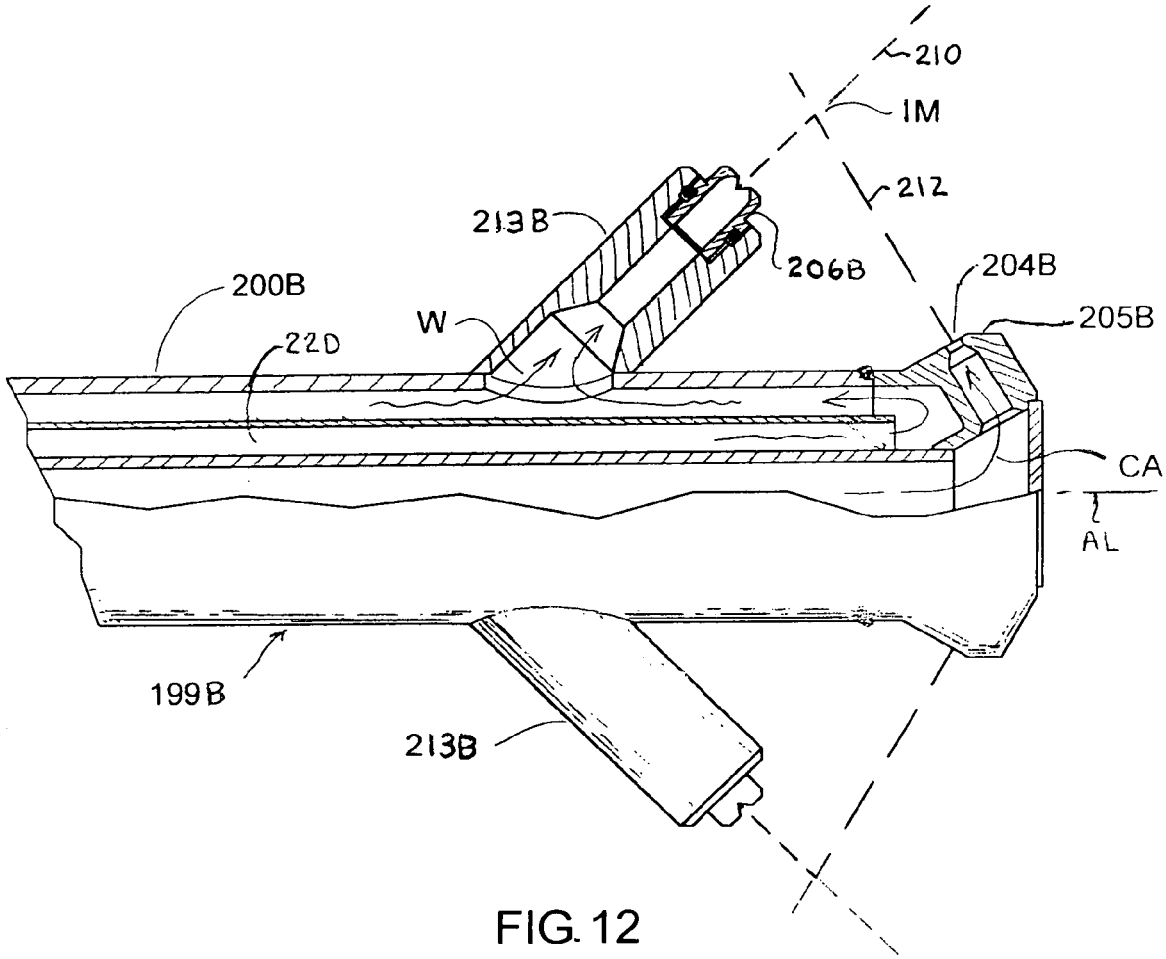
FIG. 12 is a partial cross section, similar to FIG. 11, showing a snow making head which carries out the invention.
Figure 12A:
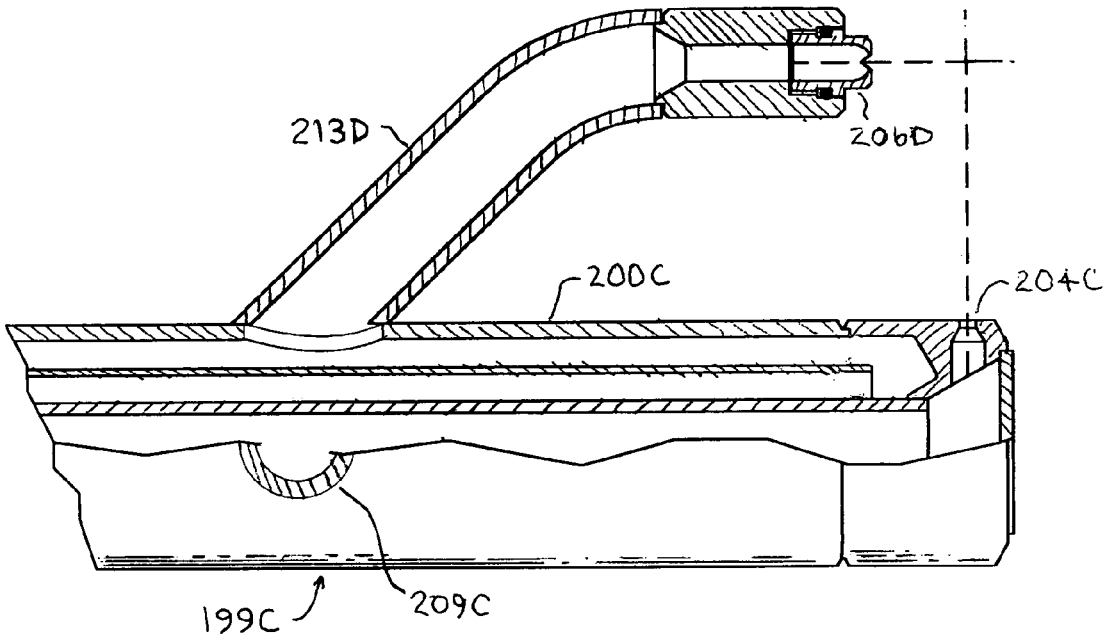
FIG. 12A shows a modification of the head of FIG. 11, having three water nozzles, one of which has a water stream path along the gun centerline.

FIG. 11 shows a portion of a simplified snow making head 199 of the present invention in vertical centerline cross section. FIG. 12 and FIG. 12A show partial cutaway views of preferred embodiment heads 199B and 199C, which may be fabricated of welded and machined aluminum alloy tubing. Numbered features in FIGS. 12 and 12A which correspond with those of FIG. 11 have the suffix B and C respectively. For simplicity, the drawings do not illustrate many small design refinements which maybe employed to inhibit freezing and adhesion of ice to various parts of the head. For example, water preferably flows through an unshown orifice plate located at the downstream end of annular passage 220, to direct the water more forcefully against the interior of tip 214. See the aforementioned U.S. Pat. No. 6,129,290, for related art.

In FIG. 11 shows one of two sets of identical opposing side pairs of water nozzle and associated air nozzle. The tubular, generally cylindrical, body 200 has a longitudinal axis AL and a downstream end, at tip 214. (The concept of head downstream end is discussed further below.) Compressed air flows down tube 203, inside the body, as indicated by the arrows CA, to and through air nozzle 205 which has a nozzle opening 204 and discharge end or downstream face 207. The nozzle is mounted on the end of a short tube or boss 209, projecting in an angled radial direction from the body. D is the dimension of the opening 204, which is preferably circular. Other shape air nozzle openings may be used, e.g., oblong, and they will be considered to have an effective diameter D, which is the diameter of a circular hole having an equivalent choked flow area. For example, it is within contemplation that an air nozzle may have an oblong hole, or that two or more side-by-side openings may be used. And when that is the case, there will be a hypothetical single hole which could be substituted to provide the same equivalent choked flow. The diameter of that hypothetical hole will be the effective diameter D used in practice of the invention.

Air exiting the air nozzle opening 204 produces an air stream, the centerline of which runs along air stream flow path 212. The stream or flow path 212 runs at angle C to a plane PP which is perpendicular to the longitudinal axis. Angle C is positive in the head downstream direction and negative in the head upstream direction. FIG. 11 shows angle C of about minus 40 degrees.

Preferably, angle C is negative and is between minus 5 and minus 50 degrees. When that is so, the air flow velocity vector V will have orthogonal vector components VP, in the perpendicular plane PP and VL, point in the head longitudinal upstream direction, as illustrated in FIG. 11. This feature is also discussed further below.

Water flows up the annular space around the tube 203, as indicated by arrows W, to water nozzle 206. The water nozzle is mounted at the end of tube or boss 213 which projects transversely at an angle from the exterior surface of the tubular body 200. The water, discharged as droplets, flows along water stream path 210. The water stream path 210 is at an angle B to the longitudinal axis AL of the body. Angle B is about 45 degrees in FIG. 11. Water path 210 and air path 212 intersect at point IM. There is an angle A between the centerlines of the two air stream paths. In FIG. 11, A is about 90 degrees. Point IM is a distance P from the water nozzle hole discharge surface, that is, nozzle face 211. Point IM is a distance L from the air nozzle face 207. Point IM may be moved radially relative to the body exterior if desired, by changing the locations of the water nozzle 206 and air nozzle 205, for example by making the bosses 209 and 213 extend outwardly more.

Angle A is the angle of impingement of the air stream on the water droplet stream. In the invention, the range of angle A is between 70 and 110 degrees. More preferably, the angle A is 75–90 degrees, most preferably it is about 90 degrees. In the present invention, the critical and novel relationship between the angle A and the ratio L/D provides a superior snow gun. It makes the air stream more effective than in the prior art, and thus lower pressures can be used. Despite some prior art thinking that the high angle A air stream and associated nuclei would "punch through" the water stream and be lost, tests with the invention shows better net results in snow making than for lower angles.

Preferably, distance P is about three quarters of an inch and distance L is about two and three eighths inch. In the generality of the invention, the air nozzle boss may be eliminated. For example, in FIG. 11, when angle A of about 70 degrees is desired, the air nozzle 204A, shown in phantom, may be on the exterior surface of the body with zero boss extension.

Angle B of the water nozzle relative to the body longitudinal axis is less critical and may range from 0 to 90 degrees. Angle B will be selected according to how many air and water nozzle sets there are on a head, where they are located, the exterior dimensions of the head, where snow is wanted relative to the head, and other factors. Greater angle B is preferred when there are multiple nozzles around the periphery of the body at a given body length location, for instance, if there are four or more—since it is desirable to minimize interaction of plumes of water droplets. When there is such interaction, the droplets may coalesce into undesirably large droplets. The extension or length of the nozzle bosses may also be varied to avoid coalescing, while maintaining the desired L, D, angles and other parameters of the invention.

Figure 14:
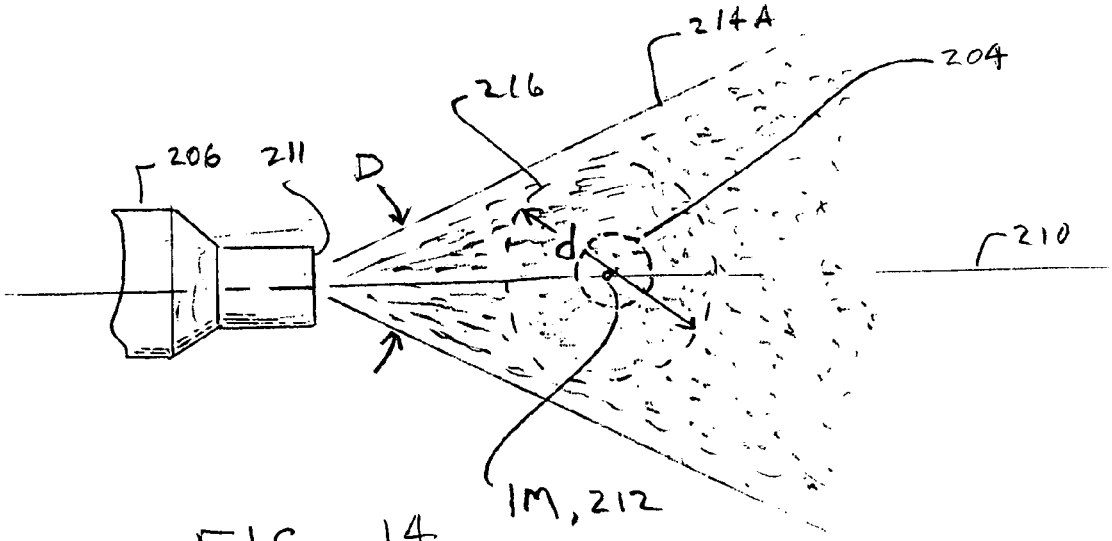
FIG. 14 is a view looking downwardly along the air stream flow path of FIG. 13, to further illustrate the interaction of the air and water streams.

Preferably, the water nozzle is a commercial type 5020, 5030, or 5040 pressure atomizing water nozzle from Spraying Systems, Inc., Wheaton, Ill., US. The nozzle mounting is modified to help avoid ice accumulation over time The foregoing manufacturer's nozzle designators indicate respectively a nominally 50 degree flat fan shape spray pattern with a rated water flow of 2, 3 and 4 gpm at 40 psig. In general, for any given pressure, lower flow rated nozzles provide finer droplet size. The water nozzle size will be chosen according to what is desired for total flow and droplet size. The angle D, shown in FIG. 14, illustrates the fan shape water droplet stream issuing from the nozzle. Angle D may be selected in the range of nominally 40 to 65 degrees, with 50 degrees being preferred, according to the dispersion of droplets which is desired, by choosing different commercial water nozzles. What a particular nozzle produces for a pattern in use is to an extent dependent on the water pressure.

The air nozzle may comprise a simple orifice 204, having a cylindrical passage with a length of about one diameter. More preferably, the air nozzle is a simple converging nozzle, as shown for the air nozzle 205B in FIG. 12.

Figure 1:
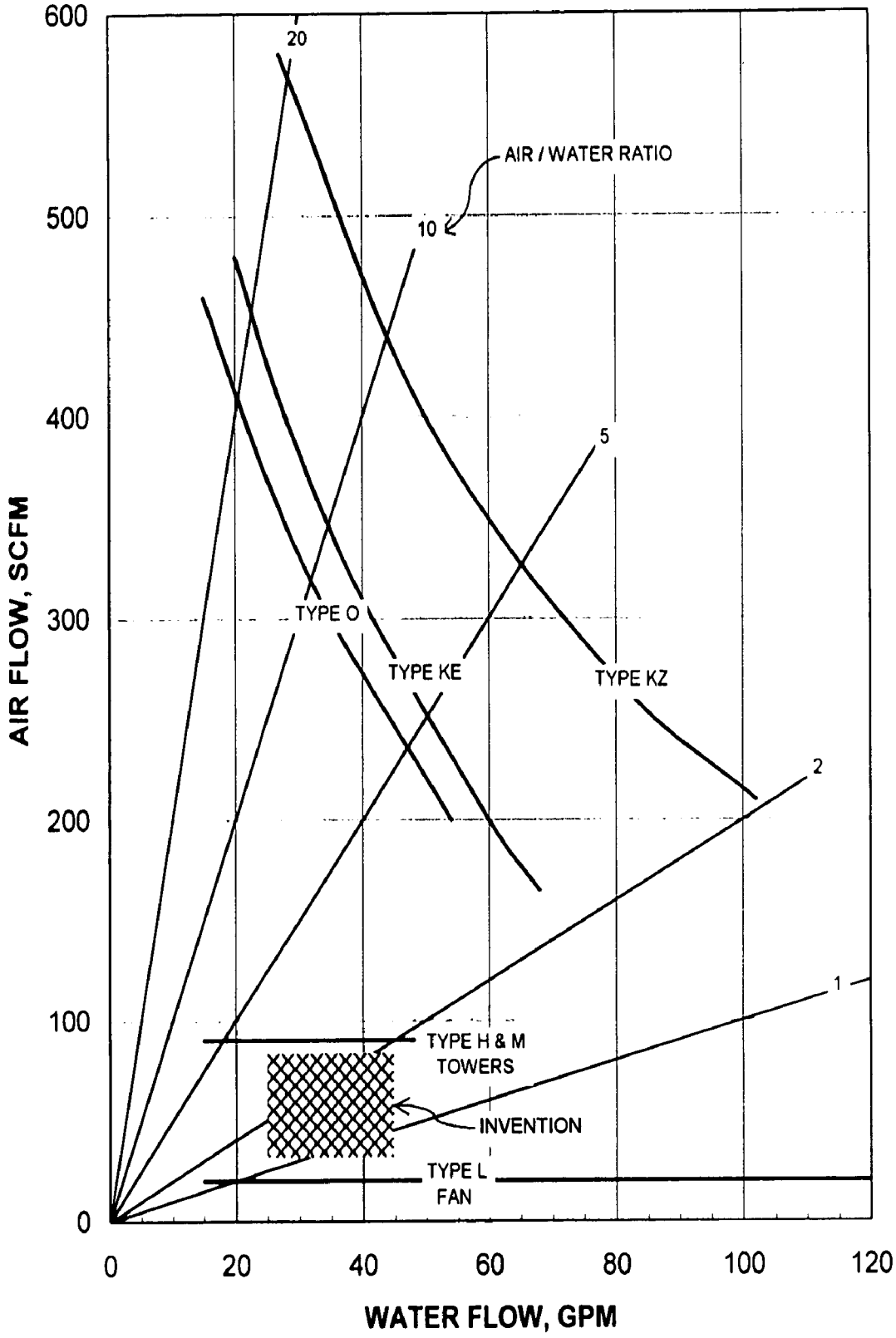
FIG. 1 shows the air and water flow characteristics of some prior art snowmakers and the invention.
Figure 13:
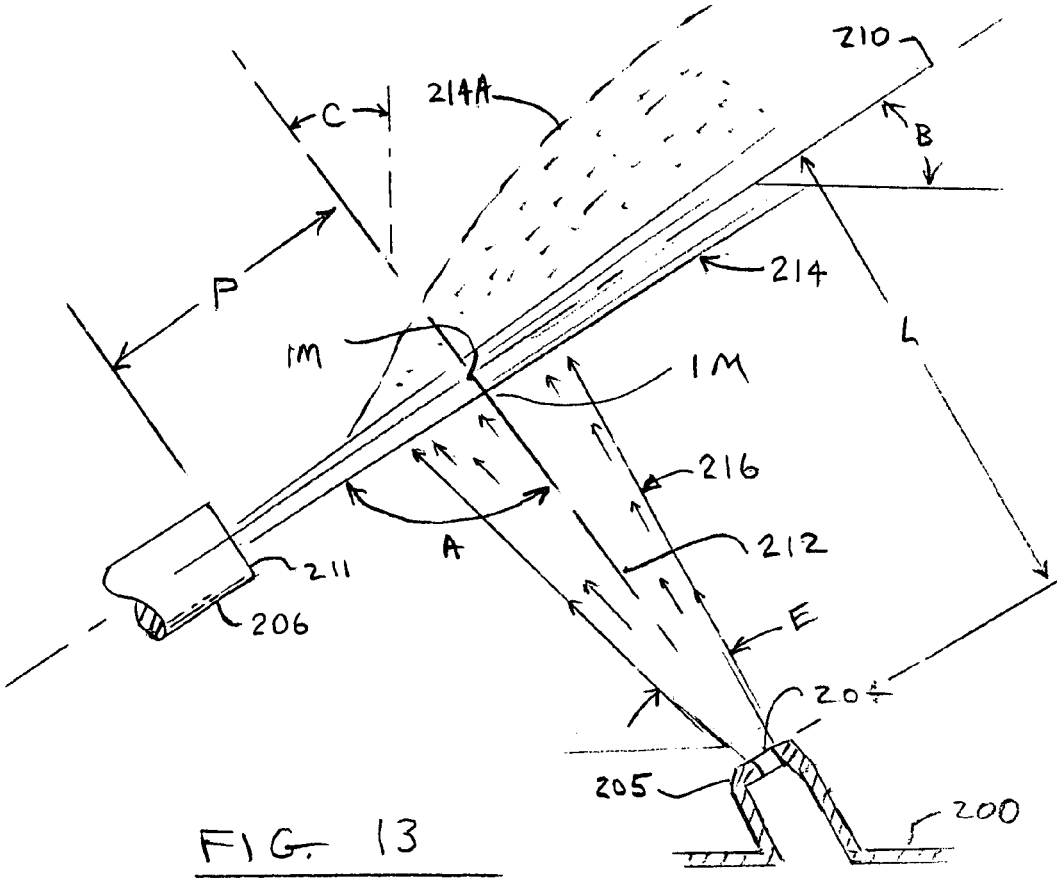
FIG. 13 shows fragments of the device of FIG. 11, to illustrate how the air stream and water stream interact and their geometric relationships.

FIG. 13 is a fragment of FIG. 1. FIG. 14 is a view looking back along axis 212 shown in FIG. 13, through the droplet stream, toward the air nozzle. Both Figures show the interaction of the air stream with the water stream. The air from the opening of nozzle 204 spreads in a conical pattern 216 having a natural spread angle E of about 16–18 degrees. The air intercepts the water stream at point IM, at which point the air stream has expanded to a nominal diameter d which approximates the width of the water plume 214. See FIG. 14. To the extent diameter d is too small to approximate the width of the spray pattern at point IM, then too may droplets will pass downstream without interaction with air. To the extent diameter d is too large, then there will be inefficient use of air, since the air stream in part bypasses the water stream.

Dashed line 214A demarcates the outer bounds of the water droplet stream, also called the plume. The angle D of divergence of the fan spray plume in the plane perpendicular to the page of FIG. 13, which divergence is shown in FIG. 14, was previously discussed. If one looks at the plume "edge-on" as in FIG. 13, when no air is flowing, the plume is essentially flat. When air impacts the water stream, the plume is deformed or expanded, as illustrated by boundary 214A in FIG. 13.

Droplets from a water nozzle must be sufficiently small to be cooled and freeze before they hit the ski slope surface. To persons in the prior art, that predominately has meant, in the first instance, to use high water pressures. Pressures in the range of 200–600 psig are common. Manufacturers of water nozzles say droplets of about 100 to 300 average Sauter Mean Diameter will be mostly produced for nozzles having flow rates of interest to most snow making artisans. The droplets will travel downstream along the water flow path with an average initial velocity of about 120–300 feet per second (fps). Another concept from the prior art is to have the air stream help to move the water droplets downstream. An associated concept is that interaction between with nuclei and water droplets should occur as long as possible along the water flow path. Thus in the prior art, we typically observe angles B of no more than 45 degrees, and as small as 25 degrees, in combination with angles A of 45–65 degrees.

In the present invention, air at the point IM will typically have a calculated average velocity in the range 200–700 fps. That velocity will vary with air pressure, distance L, and diameter D. The air velocity at IM is much less than the velocity at the air nozzle opening 204, but it is still quite consequential.

Generally, in the invention, so long as the relationship between the air nozzle and water nozzle is preserved, they can be oriented in any desired direction relative to a head; and, the head may have some other shape than is shown in the Figures here. However, a head like those shown in FIG. 12 and FIG. 12A, with a tubular body, is preferred. The tubular body is a familiar design which is economic to fabricate, durable, and adaptable to anti-icing techniques. The flow of water droplets from a tubular head in the prior art is typically along the longitudinal axis AL of the body, since the water nozzles are oriented so the stream has a velocity component in such direction, which is called the downstream direction of the head, as distinguished from the directions of water stream or air stream. With the tubular body and with water nozzles which are angled so droplets flow in the head downstream direction, as shown in FIG. 12, and when using the range of angles A of the present invention, the air is less helpful in propelling the droplets downstream than in prior art devices, because, as discussed for FIGS. 11 and 13, the air stream has a vector VL which, with reference to geometry and the Figures, is in the upstream direction relative to the head longitudinal axis orientation, i.e., to the left in the Figure. Of course, if differently viewed, with the water stream 210 as the basis for direction reference, the velocity vector of the air stream is only upstream for angles A between 90 and 100 degrees.

Based on experimental observations, angles A of the present invention have a significant effect in providing smaller water droplets. That makes it easier to create snow under elevated wet bulb conditions when air pressure is substantially lower than in the prior art. When the droplets in a plume are dispersed, or spread apart, by the impact of the air—which is enhanced by high angle A, they will not so readily re-coalesce as larger droplets. With the angles A of the invention, for any given water and air stream velocity set, there is greater air velocity relative to the droplet velocity than in the prior art. Relative velocity is the vector-resolved difference in air stream and water stream velocity in vicinity of point IM. With higher relative velocity, there is more impingement of shearing force on the droplets, to break them up. And, there will be a greater transfer of momentum to droplets.

Another parameter of importance, especially for snow making heads operated at low pressures, is the ratio L/D, that is, the relationship between the distance to point IM in relation to the effective diameter of the air nozzle. D, which determines the quantity of air which will flow per unit time for a given pressure, will be chosen according to the amount of air flow needed, which in turn is dependent on the desired water/air ratio, previously discussed. (The pressure delivered to a head of the present invention may be high pressure, as in the prior art, or low pressure as described above. In claiming the snow making head invention herein, unless qualified, a reference to supply of compressed air to the head refers to the condition of the air which is just upstream of the head/nozzle, that is, irrespective of whether the air was compressed to high pressure and then reduced by throttle, or simply compressed only to low pressure.)

Figure 15:
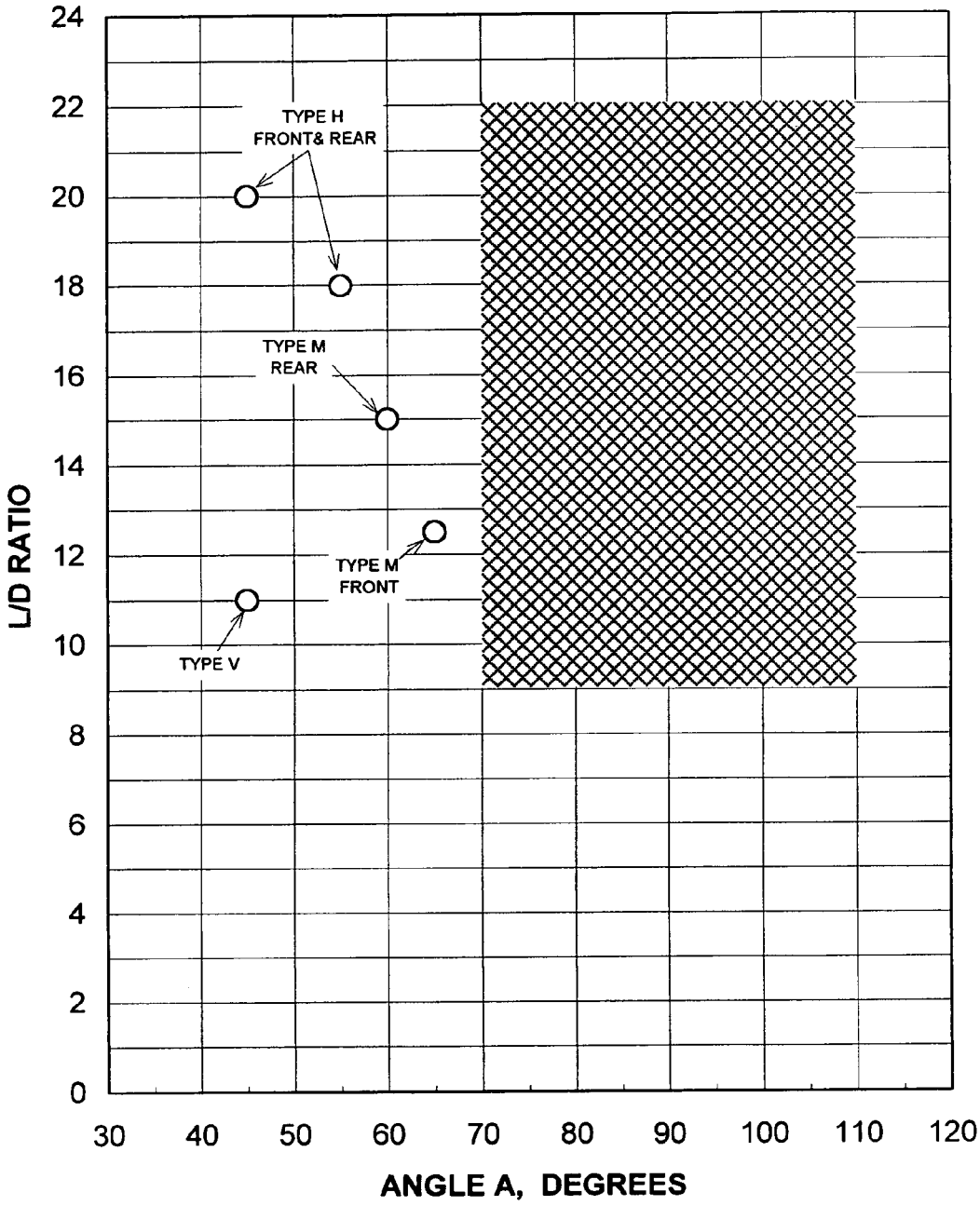
FIG. 15 shows the relationships between L/D and angle A for the invention, along with like data for some prior art snow making head.

In the invention, the ratio L/D is controlled in the range of about 9:1 to about 22. More preferably L/D is between about 13:1 and about 18:1; most preferably L/D is about 14–16. In the invention, with the foregoing L/D ranges, angle A is between 70–110 degrees, more preferably 75–90 degrees; most preferably about 90 degrees. FIG. 15 graphically illustrates the preferred relationship of L/D and A in the invention and compares that to some prior art compressed air units, including those of the types previously mentioned.

The following is an example of a nozzle for a preferred snow gun head: Angle A is 90 degrees, angle B is 45 degrees, angle C is 40 degrees, and angle S is nominally 55 degrees. L/D is about 16:1, L is about 2.5 inch, D is about 0.155 inch. Water supplied to a 5040 nozzle at about 300 psig and flows at about 11 gpm. In one mode of operation, air is supplied to the air nozzle at 95 psig with a resultant air flow of about 37 scfm, such as when the wet bulb temperature is around 28 deg F. In another mode of operation, when the wet bulb temperature is about 20 deg F., air pressure will be about 30 psig and the resultant air flow will be about 15 scfm. A snow making head will preferably have a multiplicity of nozzle pairs, at least two, more preferably four. Alternately, a head has three water nozzles (with associated air nozzles). Two, are at the ends of are opposing side bosses 209C, as shown in FIG. 12. A third nozzle 206D is at the end of bent tube-boss 213D, which is located circumferentially 90 degrees from either other nozzle 209C, as illustrated by FIG. 12A.

Figure 2:
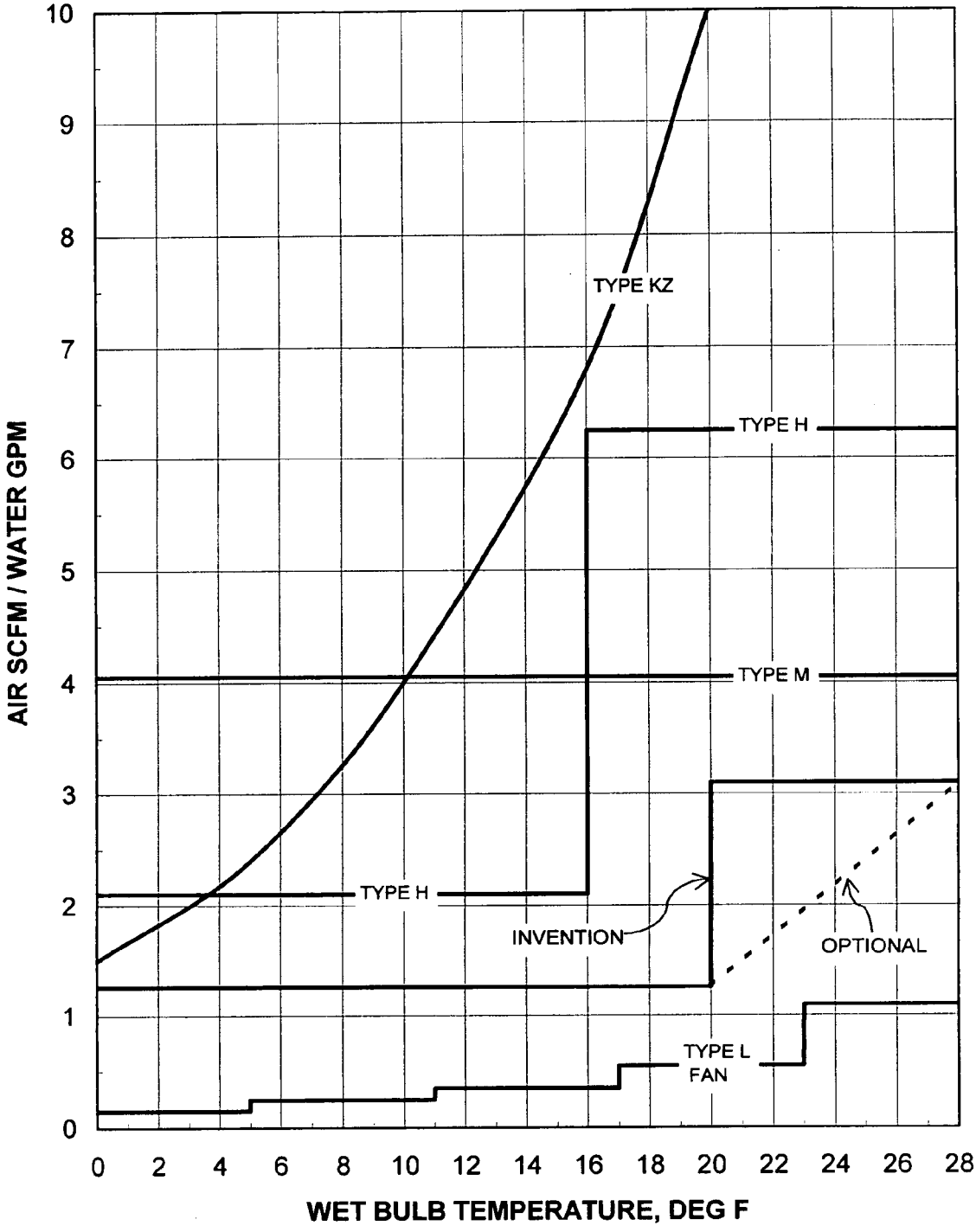
FIG. 2 shows how the air to water flow ratio must be increased with increasing wet bulb temperature, in order to make snow with certain prior art units and the invention.

The performance and benefit of the invention, using a preferred head and low pressure is graphically displayed in FIG. 1 and FIG. 2, in comparison to prior art units. With reference to FIG. 2, the performance curve for the invention reflects operation of a head with 95 psig air in the wet bulb temperature range 20–28 deg F., and 30 psig air for temperature less than 20 deg F. A superior air to water ratio is obtained across the wet bulb range. That means that for a given water flow, and a given amount of snow production, less air is needed. The invention is substantially superior to prior art external mix units of the same essential type, namely, those in which compressed air interacts with water spray in the atmosphere. It is only excelled by the fan type unit, which employs a different principle of operation, and is much more complex and costly.

The invention can be applied to a head having a multiple sets of water nozzle and air nozzle, for example, to units which have front sets and rear sets, as shown in the prior art patents mentioned above. In general, the invention can be applied to any type of external mix snow maker.

Figure 16:
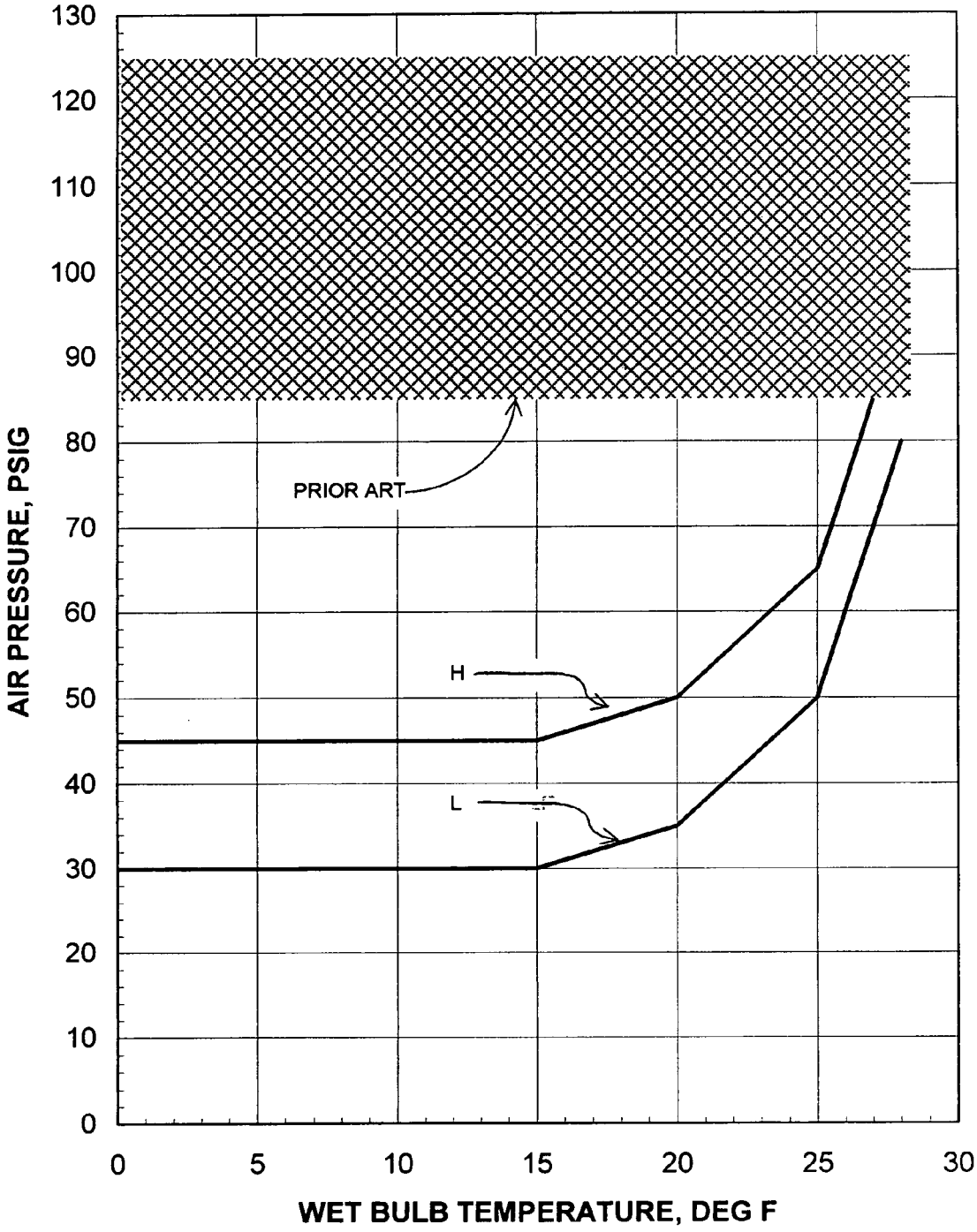
FIG. 16 shows how the air pressure provided to the nozzle at a snow making head, like that illustrated in FIG. 12, is altered as a function of wet bulb, and as a function of water flow to the water nozzle, in comparison to prior art systems.

FIG. 16 illustrates, as an example, approximately how the air pressure to a snow making head of the preferred design will be varied according to wet bulb temperature. The upper bound H represents use of a high flow water nozzle, e.g., a commercial 5040 nozzle, while the lower bound L represents a lower flow water nozzle, e.g., a 5015 nozzle, when either nozzle is supplied with about 350 psig water. The Figure shows how, when the wet bulb temperature is low, lower pressure can be used. And, when a high water flow nozzle is used, pressure will be higher, because there is a beneficial effect of the impact of the resultant higher air flow on the droplet plume.

The performance and benefit of the invention, using a preferred head and low pressure is graphically displayed in FIG. 2, in comparison to prior art units. The solid line curve for the invention reflects operation of a head provided with 350 psig water, where 95 psig air is supplied in the wet bulb temperature range of 20–28 deg F., and 30 psig air is supplied for temperatures less than 20 deg F. The dashed line shows an optional preferred mode of operation, where in the range 20–28 deg F. air pressure is progressively dropped with wet bulb temperature from 95 psig to 30 psig. However, it may not practical to carry out that mode in every day operations, as ski slope snow making systems are presently configured and operated.

With the invention, FIG. 2 shows that a superior air to water ratio is obtained across the whole wet bulb range. Thus, for a given water flow, and a given resultant amount of snow production, less air is needed, and energy cost for compressing air is substantially reduced. The invention is substantially superior to prior art external mix units of the same essential type, namely, those in which compressed air interacts with water spray in the atmosphere. It is only excelled by the fan type unit, which employs a different principle of operation, and is much more complex and costly.

As the foregoing description supports, the lower the air pressure, the more the air/water flow ratio is improved, and the more efficient snow making results. Thus, surprisingly substantial savings result when air pressure is reduced and the preferred snow making head is used. As an approximation, if an installation having a fixed number of snow making units operating at 95 psig is compared to the same system having the same number of units operating at 30 psig, energy consumption for compressed air may be reduced by about 60%. When the system operates at 80 psig, compared to 95 psig, the savings may be about 15%.

Although this invention has been shown and described with respect to a preferred embodiment, it will be understood by those skilled in this art that various changes in form and detail thereof may be made without departing from the spirit and scope of the claimed invention.

I claim:

1. A snow making head comprising:

a body, having a longitudinal axis;

a water nozzle, for providing water droplets which flow along a water stream path; and, an air nozzle, having an effective diameter D, for discharging compressed air supplied to the head, so the air flows along an air stream path;

wherein the centerline of the air stream path intersects the centerline of the water stream path at point IM, at distance L from the air nozzle;

wherein the included angle A between said centerlines at point IM is between about 70 and 110 degrees; and wherein the ratio of L/D is between about 9:1 and 22:1.

2. A snow making head comprising:

a generally tubular body, having a longitudinal axis and a downstream end;

a water nozzle, attached to the body, for providing water droplets which flow along a water stream path, with a velocity component in the downstream direction of said longitudinal axis; and, an air nozzle, attached to the body, having an effective diameter D, for discharging compressed air supplied to the head, so air flows along an air stream path at an angle C measured from a plane perpendicular to the longitudinal axis of said body, with a velocity vector component in the upstream longitudinal axis direction of the body;

wherein the centerline of the air stream path intersects the centerline of the water stream path at point IM, at distance L from the air nozzle;

wherein the included angle A between said centerlines at point IM is between about 70 and 110 degrees.

3. The snow making head of claim 2, wherein the ratio of L/D is between about 9:1 and 22:1.

4. The snow making head of claim 1 or 2 wherein angle A is greater than 75 degrees and less than 90 degrees.

5. The snow making head of claim 1 or 2 wherein the L/D ratio is between about 13:1 and 18:1.

6. The snow making head of claim 1 or 2, wherein the said water nozzle is at the end of a boss which projects transversely from the exterior of the body.

7. The snow making head of claim 1 or 2, further comprising one or more additional pairs of similarly configured and arranged air and water nozzles, the pairs of nozzles spaced apart around the exterior surface of the body.

8. The snow making head of claim 1 or 2 wherein the air nozzle comprises a multiplicity of small ports having an air flow area equal to a single circular hole of effective diameter D.

9. A snow making bead comprising:

a body, having a longitudinal axis;

a water nozzle for providing water droplets which flow along a water stream path; and, an air nozzle, having an effective diameter D, for discharging compressed air supplied to the head, so the air flows along an air stream path at an angle C measured from a plane perpendicular to the longitudinal axis of said body;

wherein the centerline of the air stream path intersects the centerline of the water stream path at point IM, at distance L from the air nozzle;

wherein the included angle A between said centerlines at point IM is between about 70 and 85 degrees; and, wherein angle C is between minus 5 and minus 50 degrees.

* * * * *